US006769982B1

(12) United States Patent
Brosnan

(10) Patent No.: US 6,769,982 B1
(45) **Date of Patent: *Aug. 3, 2004**

(54) VIDEO PACHINKO ON A VIDEO PLATFORM AS A GAMING DEVICE

(75) Inventor: William J. Brosnan, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/553,438

(22) Filed: Apr. 19, 2000

(51) Int. Cl.[7] ..... G07F 17/34
(52) U.S. Cl. ..... 463/16; 273/121 B
(58) Field of Search ..... 463/20, 19, 16; 273/121 B

(56) References Cited

U.S. PATENT DOCUMENTS

| | | | | | |
|---|---|---|---|---|---|
| 1,843,587 | A | * | 2/1932 | Wolin et al. | 273/121 B |
| 4,805,907 | A | * | 2/1989 | Hagiwara | 463/26 |
| 4,856,787 | A | | 8/1989 | Itkis | 273/237 |
| 4,986,543 | A | * | 1/1991 | Heller | 273/118 A |
| 5,120,060 | A | * | 6/1992 | Parker et al. | 273/138.2 |
| 5,131,655 | A | * | 7/1992 | Ugawa | 273/121 B |
| 5,242,163 | A | | 9/1993 | Fulton | 273/85 |
| 5,509,655 | A | | 4/1996 | Ugawa | 273/121 B |
| 5,580,309 | A | * | 12/1996 | Piechowiak et al. | 463/16 |
| 5,613,911 | A | * | 3/1997 | Takemoto et al. | 463/25 |
| 5,722,891 | A | | 3/1998 | Inoue | 463/20 |
| 5,725,210 | A | | 3/1998 | Yamaguchi et al. | 273/121 B |
| 5,775,993 | A | * | 7/1998 | Fentz et al. | 463/17 |
| 5,836,819 | A | * | 11/1998 | Ugawa | 273/121 B |
| 5,890,715 | A | * | 4/1999 | Gomez et al. | 273/118 A |
| 5,904,352 | A | * | 5/1999 | Takemoto | 273/121 B |
| 6,029,973 | A | | 2/2000 | Takemoto | 273/121 B |
| 6,047,963 | A | | 4/2000 | Pierce et al. | 273/121 B |
| 6,131,909 | A | | 10/2000 | Chilese | 273/292 |
| 6,139,013 | A | | 10/2000 | Pierce et al. | 273/121 B |
| 6,159,095 | A | | 12/2000 | Frohm et al. | 463/19 |
| 6,203,009 | B1 | | 3/2001 | Sines et al. | 273/121 B |
| 6,203,428 | B1 | * | 3/2001 | Giobbi et al. | 463/16 |
| 6,213,875 | B1 | | 4/2001 | Suzuki | 463/20 |
| 6,213,877 | B1 | * | 4/2001 | Walker et al. | 463/22 |
| 6,220,593 | B1 | * | 4/2001 | Pierce et al. | 273/121 B |
| 6,270,409 | B1 | * | 8/2001 | Shuster | 273/143 R |
| 6,340,158 | B2 | | 1/2002 | Pierce et al. | |
| 6,375,567 | B1 | * | 4/2002 | Acres | 463/25 |
| 6,398,645 | B1 | * | 6/2002 | Yoseloff | 463/19 |

FOREIGN PATENT DOCUMENTS

| | | | | |
|---|---|---|---|---|
| GB | 2239547 A | * | 7/1991 | G07F/17/34 |
| GB | 2 327 794 A | | 3/1999 | G07F/17/34 |

OTHER PUBLICATIONS

John Scarne, Scarne On Cards, 1949, Crown Publishers, p. 243.*

* cited by examiner

*Primary Examiner*—Jessica Harrison
*Assistant Examiner*—Corbett B Coburn
(74) *Attorney, Agent, or Firm*—Beyer, Weaver & Thomas LLP

(57) ABSTRACT

A disclosed gaming machine presents pachinko games to a player playing the gaming machine. In some embodiments, a player may initiate a new pachinko game on the gaming machine while the outcome of a previous pachinko game is being presented to the player. The wagers on each game may be different. Also, a player may input parameters into the gaming machine that affect the game outcome presentation. For a number of different games, two or more game outcomes may be presented simultaneously to the player on the gaming machine. However, the game outcomes determined by the gaming machine are independent of one another and do not depend on the game outcome presentation. Normally, the game outcomes are determined using a random number generator and a pay table stored in a memory on the gaming machine.

57 Claims, 10 Drawing Sheets

VIDEO PACHINKO ON A VIDEO PLATFORM AS A GAMING DEVICE

BACKGROUND OF THE INVENTION

This invention relates to game playing methods for gaming machines such as slot machines and video poker machines. More particularly, the present invention relates to methods of allowing game players to play video pachinko on a gaming machine.

There are a wide variety of devices that can comprise a gaming machine such as a slot machine or video poker machine. Some examples of these devices are lights, slot reels, ticket printers, card readers, speakers, bill validators, coin acceptors, display panels, key pads, bonus wheels, and button pads. These devices provide many of the features which allow a gaming machine to present a game. Some of these devices are built into the gaming machine. Often, a number of devices are grouped together in a separate box that is placed on top of the gaming machine. Devices of this type are commonly called a top box.

Typically, utilizing a master gaming controller, the gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate a game play. These steps require the gaming machine to operate input devices including bill validators and coin acceptors to accept money into the gaming machine and recognize user inputs from devices including key pads and button pads to determine the wager amount and initiate game play.

After a game has been initiated on the gaming machine, the gaming machine determines a game outcome and presents the outcome of the game to a player. For example, for a slot game, after a player has initiated a game by pressing an input button or pulling a handle attached to the gaming machine, the gaming machine determines a game outcome which is the final position of each reel on the slot machine. A requirement for most gaming machines is that the probability of each game outcome is precisely known and remains constant during game play. Thus, when a player plays two or more games on a gaming machine the probability of a particular game outcome is the same for each game that the player initiates.

After the gaming machine determines the game outcome, the outcome of the game is presented to the player. For the slot game, the game outcome presentation might include a number reels spinning, visual effects including flashing or strobing lights and auditory effects including bells and whistles. The game outcome presentation, including the various visual and auditory effects, is designed to add excitement to the game being played on the gaming machine and encourage additional game play.

Usually near the end of the game outcome presentation, the game outcome is presented. For example, for the slot game, the reels stop at a final position. Based on the game outcome, the gaming machine may notify the player of an award of a varying amount or notify the player that the wager made on the game was lost. For example, for a slot game with three slot reels, when the final position of each reel corresponds to the display of an identical symbol including three cherries, three bars or the like, a player might be awarded a credit of 5 times the initial wager made on the game. However, other symbol combinations including 2 cherries and a bar or two bars and a cherry might result in a loss of the wager made on the game. Further, each time a player plays a game the probability of a particular game outcome such as three cherries or three bars will usually be the same. After the game outcome has been presented, a player may initiate a new game by making a new wager on the gaming machine and initiating the next game play.

The amount of game play on a gaming machine is usually a function of the type of game. A few examples of games that are played on video gaming machines are slot games, poker, black jack, and keno. Among these games, slot games and video poker are probably the most popular. A casino typically offers various types of games because many game players are attracted to some games but dislike others. When a player wants to play a game on a gaming machine but does not like any of the offered games, this person may choose not play. Also, when a player finds a particular game only mildly exciting, the player may become disinterested after a short time and cease their game play. Thus, to increase game play, new games are desired that may attract players previously uninterested in game play on a gaming machine. Accordingly, to attract new players, new games for gaming machines are desired that are exciting and are interesting enough to hold a player's interest over a long period of time.

An exciting game which may draw new players to game play on a gaming machine and hold their interest for extended periods is pachinko. A single game of mechanical pachinko involves dropping a ball through a portion of a vertical box. The ball starts at the top of the box and is drawn through the box via the force of gravity. A large number of obstacles are arranged within the box. As a ball falls through the box, the trajectory of the ball is altered by collisions with the obstacles. A number of objects are placed within the box that allow a ball to exit the portion of the box where the collisions are taking place. A game outcome is determined by the exit from which the ball leaves the box. The game is designed such that it is very difficult to predict the trajectory of the ball within the box and hence the exit from which the ball leaves.

The history of pachinko is uncertain. One theory is that it originated in the United States in Chicago, Ill. in the early 1920's. Another theory is that it originated in France or England. At some point in the early 1920's, the game was imported to Japan. Within Japan, the game has gained a large following as a source of amusement and is very popular. Currently, mechanical pachinko games are manufactured by many companies mostly residing in Japan.

Traditionally, pachinko is played with metallic balls in a thin vertical box. The front surface of the box is composed of a transparent material that allows a player to view what is inside the box. The back of the box is usually composed of an opaque material. Between the front and back surfaces of the box are usually a large number of thin cylindrical pegs that are perpendicular to the front and back surfaces. Further, these pegs span the distance between the front and back surfaces. The diameter of the pegs is usually much smaller than the diameter of the metallic balls used to play the game and the distance between the front and back vertical surfaces is usually not much greater than the diameter of the balls. In early versions of mechanical pachinko, the back of the box was made of plywood with nail driven through the wood to serve as obstacles. Pegs are the most common type of obstacle but other obstacles may also be placed in the box. These obstacles alter the trajectory of a ball as it passes through the box.

Usually, a pachinko game includes a mechanism that places the balls at the top of the box. The mechanism may include inputs that allow the player to influence the initial position and velocity of the ball at the top of the box. The trajectory of the ball through the box is extremely sensitive to the initial position and velocity of the ball at the top of the box. The sensitivity makes it very difficult to predict the trajectory of the ball through the box.

The game of pachinko is easy to understand. Typically, a potential player can quickly understand the rules of the game and begin playing. Further, a player may influence the game presentation. As described above, a pachinko game usually includes a mechanism that allows a player to determine the initial velocity and position of the ball at the beginning of the game. The initial velocity and position of the ball affect the trajectory of the ball and hence the game presentation. This player interaction differs from a game such as slot games where the game presentation is similar for each game. The potential for player interaction in the game presentation for pachinko adds to the excitement of the game.

A disadvantage of mechanical pachinko games and a limitation to their utilization as a gaming device is the difficulty in precisely determining the probability of each game outcome on a particular machine. Besides the initial position and velocity of the ball at the top of the box, the trajectory of a ball may be affected by the specific manufacturing tolerances of each machine, the manufacturing tolerances of each ball, and the precise orientation of the pachinko machine. Further, with repeated game playing, aspects of the mechanical pachinko game may be altered in a manner which changes the probability of game outcomes on a particular machine. Accordingly, it would be desirable to provide a pachinko-like game where the probability of each game may be precisely determined such that the probabilities do not vary with time on a particular gaming machine and the probabilities may be duplicated on different gaming machines.

Traditionally, game play on a gaming machine such as a slot machine, video poker machine, is presented sequentially. For example, for a slot game after a player has made deposited money or a credit of indicia into the gaming machine, a player makes a wager and initiates a game play. Then, the gaming machine determines a game outcome and presents the game outcome. A player is not able to make a new wager and initiate another game on the gaming machine until the presentation of the outcome of the previous game is complete.

A disadvantage of many games played on a gaming machine is that the sequential game play limits the gaming throughput. On a gaming machine, the gaming throughput is the maximum number of games that can be played on the gaming machine in a fixed period of time. The length of a game may be defined as the sequence of a player making a bet and initiating a game play and the gaming machine determining and presenting a game outcome. For example, on a slot machine, this game sequence usually requires about 3–5 seconds. Thus, in this example, the gaming throughput for this machine is about 0.2 to 0.3 games/second.

The profitability of a gaming machine is usually related to the product of the gaming throughput and the average wager per game. Typically, casino operators prefer gaming machines with a high profitability because the house share or drop is a percentage of the wagers made on the gaming machine. For a slot machine, the average wager per game may be increased by offering multiple wagering opportunities such as multiple paylines. This game playing methodology may increase the average wager per game. However, it may also decrease the gaming throughput because of the time needed to make multiple wagers.

Typically, for most games played on a gaming machine, the majority of time in a game sequence is consumed by the game outcome presentation. For example, for a slot game, the game outcome presentation involves the slot reels spinning and stopping at a final position. Typically, the length of the game outcome presentation is made as short as possible to increase the game throughput. However, when the game outcome presentation becomes too short a player may lose interest in the game. Thus, for sequential game play on a gaming machine, the gaming throughput is usually limited by the presentation of the game outcome. Accordingly, it would be desirable to provide games for a gaming machine which overcomes the limitations of sequential game outcome presentations and increases the gaming throughput of a gaming machine.

SUMMARY OF THE INVENTION

This invention addresses the needs indicated above by providing a gaming machine which presents pachinko games to a player playing the gaming machine. In some embodiments, a player may initiate a new pachinko game on the gaming machine while the outcome of a previous pachinko game is being presented to the player. The wagers on each game may be different. Also, a player may input parameters into the gaming machine that affect the game outcome presentation. For a number of different games, two or more game outcomes may be presented simultaneously to the player on the gaming machine. However, the game outcomes determined by the gaming machine are independent of one another and do not depend on the game outcome presentation. Normally, the game outcomes are determined using a random number generator and a pay table stored in a memory on the gaming machine.

One aspect of the present invention provides a gaming machine that generally can be characterized as including (1) a video display for displaying a pachinko game and (2) a master gaming controller for determining the outcome of the pachinko game and providing instructions for presenting the outcome as a pachinko game sequence on the video display. The gaming machine may also include a pay table stored on a memory device, wherein the master gaming controller uses the pay table to determine the outcome of the pachinko game. Typically, the game outcome of each pachinko game is not related to the pachinko game outcome of any other game. However, in some embodiments, the pachinko game outcome may be to the related to a wager amount made on the pachinko game.

In preferred embodiments, the master gaming controller provides instructions for simultaneously displaying two or more pachinko game sequences for which the game outcomes were previously determined. The game outcome presentations from the two or more pachinko game sequences may appear to interact on the display screen. Further, the game outcome presentation of a pachinko game may include a presentation of a bonus game where the master gaming controller provides instructions for displaying the bonus game. The bonus game presentation may be related to an award including a progressive award. The game outcome of a first pachinko game and the probability of a bonus game presentation may be affected by 1) a wager amount made on the first game and 2) how many pachinko game outcome presentations are presented simultaneously with the first pachinko game outcome presentation. Additionally, the first pachinko game outcome may be determined by the master gaming controller from a first pay table and a second pachinko game outcome may be determined by the master gaming controller from a second pay table.

In preferred embodiments, the gaming machine may include a player input mechanism where the player input mechanism is used by a player to initiate play of the pachinko game and affect the pachinko game outcome presentation on the display screen. Further, the player input mechanism may be used to select a game presentation mode where the game presentation mode is selected from the group consisting of a pachinko ball speed, a pachinko ball size, a pachinko ball elasticity, a pachinko game background pattern and a pachinko game layout. For two pachinko games, a first game presentation mode for a first pachinko game may be different from a second game presentation mode of a second pachinko game.

In preferred embodiments, a first pachinko game may be initiated by a first player and a second pachinko game may be initiated by a second player different from the first player where the pachinko game outcome presentation from the first pachinko game is presented simultaneously with the pachinko game outcome presentation of the second pachinko game. The pachinko game outcome presentations from the first and second pachinko games may be presented on a shared display screen receiving signals from at least the gaming machine and one other gaming machine. Additionally, one or more pachinko game outcome presentations for one or more pachinko game sequences from the gaming machine may be displayed on the display screen of a second gaming machine. Also, a game event in the first pachinko game or a pachinko game event in the second pachinko game may trigger a bonus game for the first player and for the second player.

Another aspect of the invention provides a method for controlling a gaming machine having a video display that allows play of a pachinko game on the gaming machine. The method may be characterized as including the following steps 1) receiving an input signal to initiate a pachinko game 2) determining a game outcome for the pachinko game and 3) displaying on the video display a presentation of the pachinko game outcome where the presentation shows a ball moving through a pachinko game layout. In one embodiment, the method may include the step of presenting a bonus game prior to the completion of the game outcome presentation for the pachinko game where the bonus game may be selected from the group consisting of pachinko, slot, keno, and poker. In another embodiment, the method for controlling the gaming machine may include the step of receiving a presentation mode signal prior to presenting the game outcome for the pachinko game where the presentation mode signal carries information about a pachinko ball speed, a pachinko ball size, a pachinko ball elasticity, a pachinko game background pattern and a pachinko game layout.

In preferred embodiments, the method for controlling the gaming machine may include the additional steps of a) receiving an input signal to initiate a second pachinko game prior to completion of the game outcome presentation for a first pachinko game, b) determining a game outcome for the second pachinko game and c) presenting the game outcome for the second pachinko game on the video display screen where the first game outcome presentation and the second game outcome presentation may be simultaneously displayed. Further, the first game outcome presentation and the second game outcome presentation may appear to interact. Many features may be different between the first pachinko game and the second pachinko game including the wagers, the pay table used to determine the game outcomes, and the presentation modes.

In preferred embodiments, the method for controlling the gaming machine may include the steps of 1) summing the first wager made on a first pachinko game to the second wager made on a second pachinko game prior to determining the game outcome for the second pachinko game and 2) determining the game outcome for the second pachinko game and when to present a bonus game using the sum of the first wager and the second wager. Before the game outcome presentation is determined for the pachinko game, a player input signal may be received from a player input mechanism including an input button or a touch screen. The player input signal may be used in generating the pachinko game outcome presentation. Additionally, the game outcome of a pachinko game and when to present a bonus game may depend on determining how many pachinko game outcome presentations are being presented when the input signal to initiate the pachinko game was received.

These and other features of the present invention will be presented in more detail in the following detailed description of the invention and the associated figures.

DESCRIPTION OF THE PREFERRED EMBODIMENTS

Figure 1:
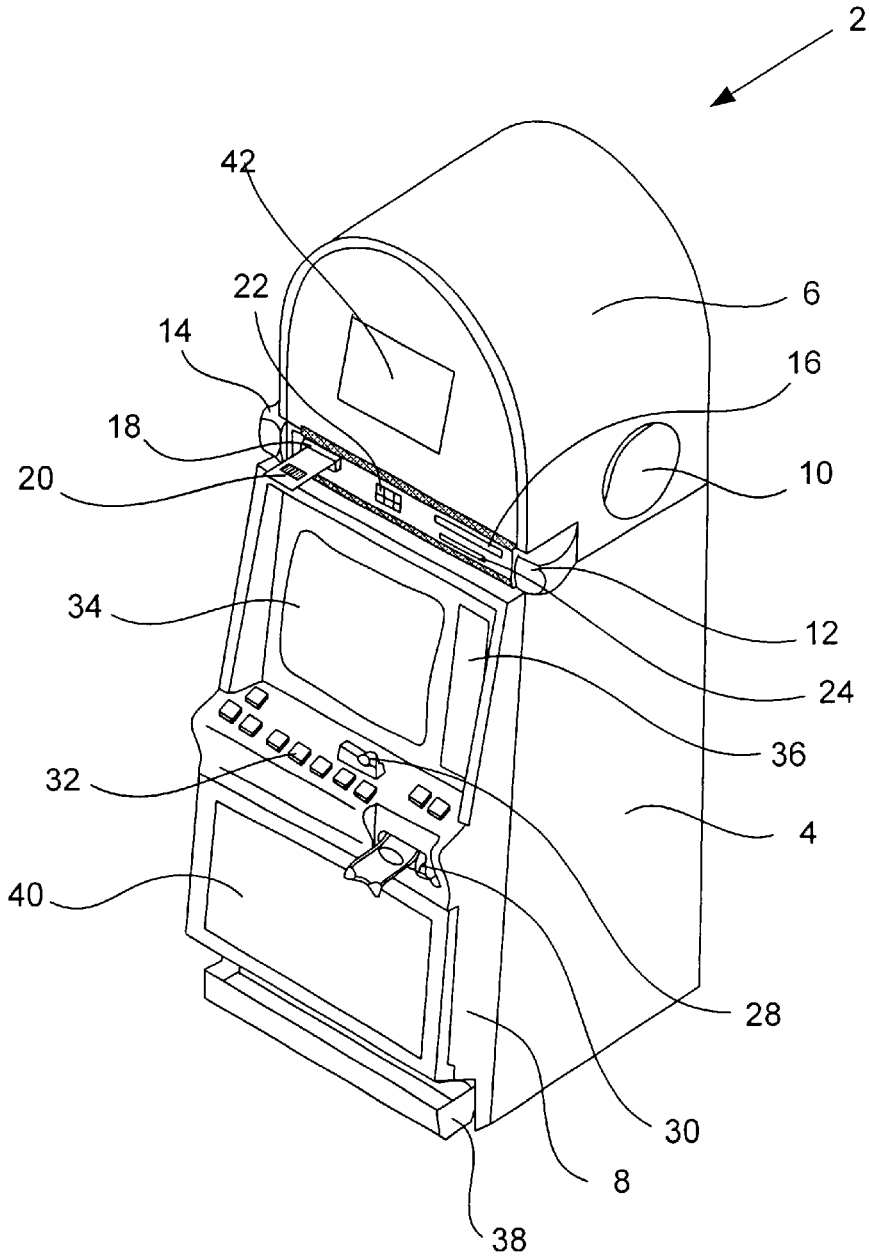
FIG. 1 is a perspective drawing of a gaming machine having a top box and other devices.

Turning first to FIG. 1, a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Typically, the main door 8 and/or any other portals which provide access to the interior of the machine utilize a locking mechanism of some sort as a security feature to limit access to the interior of the gaming machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. Further, the video display monitor 34 may be a touch screen. The touch screen may respond to inputs made by a player touching certain portions of the screen. The information panel 36 is a back-lit, silk screened glass panel with lettering to indicate general game information including, for example, the number of coins played. The bill validator 30, player-input switches 32, video display monitor 34, and information panel are devices used to play a game on the game machine 2. The devices are controlled by circuitry (not shown) housed inside the main cabinet 4 of the machine 2. Many possible games, including traditional slot games, video slot games, video poker, and keno, may be provided with gaming machines of this invention.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. Further, the top box 6 may house different or additional devices than shown in the FIG. 1. For example, the top box may contain a bonus wheel or a back-lit silk screened panel which may be used to add bonus features to the game being played on the gaming machine. During a game, these devices are controlled, in part, by circuitry (not shown) housed within the main cabinet 4 of the machine 2. The top box 6 is designed to be removable from the machine 2. Typically, the top box 6 is replaced to repair a device within the top box 6 or to install a new top box 6 with a different set of devices.

Understand that gaming machine 2 is but one example from a wide range of gaming machine designs on which the present invention may be implemented. For example, not all suitable gaming machines have top boxes or player tracking features. Further, some gaming machines have two or more game displays—mechanical and/or video. And, some gaming machines are designed for bar tables and have displays that face upwards. Those of skill in the art will understand that the present invention, as described below, can be deployed on most any gaming machine now available or hereafter developed.

Returning to the example of FIG. 1, when a user wishes to play the gaming machine 2, he or she inserts cash through the coin acceptor 28 or bill validator 30. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game, or make game decisions which affect the outcome of a particular game. The player may make these choices using the player-input switches 32, the video display screen 34 or using some other device which enables a player to input information into the gaming machine. During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 2:
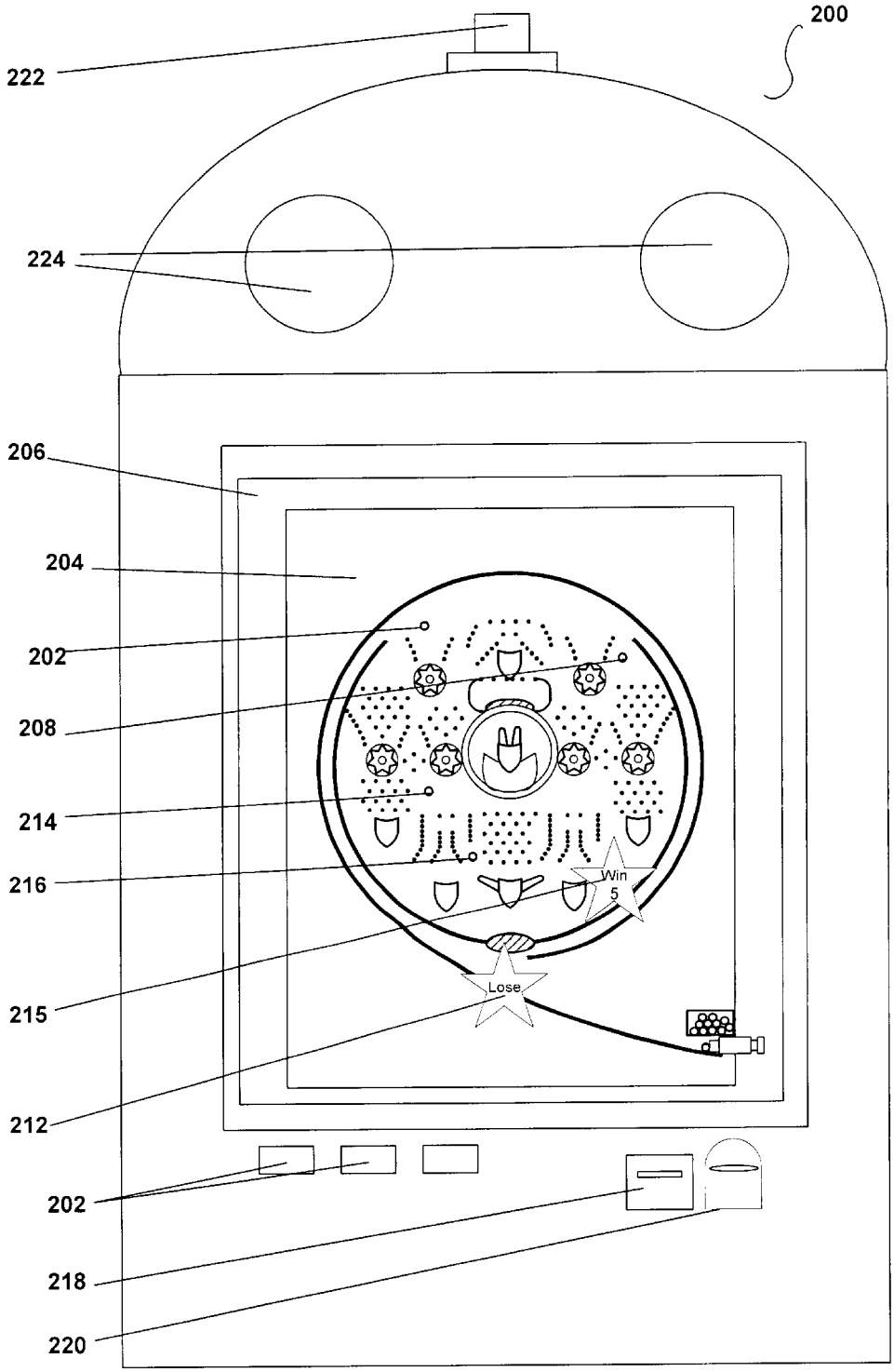
FIG. 2 is a block diagram depicting an example of a video pachinko game being played on a video gaming machine.

FIG. 2 is a block diagram depicting an example of a video pachinko game being played on a video gaming machine such as a variation of the gaming machine depicted in FIG. 1. In the embodiment of FIG. 2, the game might be implemented on a gaming machine with a touch video display screen 206, input switches 202, a bill validator 218, and a coin acceptor 220 as well as many other associated gaming devices (not shown) that provide various game features such as visual and sound effects. In FIG. 1, examples of additional gaming devices which might be used in the implementation of a video pachinko game are shown.

After a player has deposited money or indicia of credit in the bill validator 218 or coin acceptor 220, a player might initiate the following steps as part of a single game sequence 1) making a wager and 2) selecting a ball for a game play and 3) initiating a game play. The player performs these operations using the game inputs 202 and/or the touch display screen 206. Further, using the game inputs 202, a player may be able to vary the amount of the wager on a particular game. After a player has initiated a game play, the gaming machine 200 completes the game sequence by determining a game outcome and presenting the game outcome to the player on the display screen 206. Depending on the game outcome, the player may win an award or lose the wager made on the game.

A game outcome might be determined using a random number generator and a pay table stored in a memory within the gaming machine 200. The pay table is a list of game outcomes. Each game outcome is assigned a fixed probability of occurring. Thus, with the random number generator, an independent game outcome can be selected from the pay table by the master gaming controller for each game play initiated on the gaming machine 200. A number of different game outcomes may be stored in the pay table. Typically, game outcomes are either a loss of the wager on the game or an award of some type. At the end of a game outcome presentation, a loss of wager might be indicated by the "lose" contained within a displayed star for a ball "C" 212. An award might be indicated by the "win 5" contained within a displayed star for a ball "E" 215. Many awards of different values are possible. Usually, the probability of an award for a particular game play decreases as the value of the award increases. Further, the maximum value of the award available for a winning game play may increase when the wager made for the game play is increased.

On a mechanical pachinko machine, it is impossible to determine a reliable pay table because the game outcome probabilities are a function of the obstacle distribution, the gaming machine manufacturing tolerances, the ball manufacturing tolerances, the orientation of the machine or the amount of game play for a particular machine. Further, for a mechanical pachinko machine, the probability of a game outcome is not easily changed because the machine or balls must be physically altered to change the probability of a particular game outcome. For example, to change the game outcome distribution on a mechanical pachinko game, the number and distribution of the obstacles might be altered or the size or density of the balls might be increased or decreased.

An advantage of the video pachinko game of this invention is that the pay table contains precise probabilities for each game outcome and the probabilities within the pay table are easily changed. To change the pay table, a new pay table is stored in the memory within the gaming machine. Also, because the pay table is stored in a memory location on the gaming machine, the pay table may be easily duplicated in one or more video pachinko machines. These features are essential for using pachinko as a game played on a gaming machine.

A video pachinko game outcome presentation typically includes at least one ball, and may include multiple balls such as a ball "A" 202, a ball "B" 208, a ball "D" 214 and a Ball "F" 216 entering a game playing area 201 and appearing to fall, as being drawn by gravity, through the game playing area 201 on the display screen 206. Each ball represents a game being played on the gaming machine. As an individual ball falls, it may appear to collide with a number of objects which alter the trajectory of the ball as it passes through the game playing area 201. At the end of the game, the ball appears to leave the game playing area 201 through one of a number of exits.

The game outcome presentation, presented by the gaming machine 200 on the game display 206, corresponds to the game outcome calculated by the gaming machine. In mechanical pachinko, a winning or losing game play is determined by which exit the ball leaves the game playing area. In this invention, the game outcome is determined before the game outcome presentation using a pay table and a random number generator. Hence, the game outcome presentation does not affect the game outcome. Thus, for a winning game play, a ball will be presented leaving the gaming playing area 201 through certain exits while for a losing game play the ball will be presented leaving the game playing area through one or more exits different from the winning exits.

The game outcome presentation for a single game sequence may utilize both visual and audio effects. The presentation of these effects is controlled by the master gaming controller. A player may view some of the visual effects of the game outcome presentation on the display screen 206. Further, a player may view additional visual effects from the light 222, back-lit display panel and other display screens attached to the gaming machine and operated by the master gaming controller. A player may hear audio effects projected from speakers 224 attached to the gaming machine. For example, a game outcome presentation for one of the pachinko games on the display screen 206 might consist of a ball, including ball "A" 202, ball "B" 208, ball "D" 214, or ball "F" 216, colliding with a number of objects as it appears to fall through the game playing area from the top of the display screen 206 to the bottom of the display screen. At the end of the game outcome presentation, the game outcome, including "Lose" for ball "C" 212 or "win b 5" for ball "E" 214, is displayed. The length of time of the game outcome presentation including the game outcome is variable but will typically last 2–5 seconds.

The game outcome presentation on the display screen 206 for each ball might be accompanied by various sound and visual effects that integrate with the trajectory of the ball. For example, as each ball appears to collide with an object, a certain sound might be projected from the speakers 224 attached to the gaming machine 200. This sound might vary depending on the type of object the ball hits. Further, each time the ball hits an object, the object might flash or light up on the display screen 206. Also, when the ball hits certain objects, additional visual effects might be provided by the lights 222 on the gaming machine.

The game playing methodology in this invention allows a new game play to be initiated by a player before the game outcome presentation of a previous game has been completed. As describe above, a game sequence may consist of the following steps by the player and the gaming machine 1) make wager (player), 2) select ball (player), 3) initiate game (player), 4) determine game outcome (gaming machine) and 5) present game outcome (gaming machine). Once a player has initiated a game, the player may proceed to make a new wager, select a ball, and initiate a second game while the gaming machine is determining the game outcome and presenting the game outcome from the first game. The wager on the first game may be the same or different than the wager on the second game. However, the probability of the game outcomes for the first, second and all subsequent games are independent of one another. Thus, the probability of a particular game outcome for a game is not affected by the game outcomes of previous games.

In another embodiment, two or more video pachinko game outcomes may be determined and presented simultaneously during a single pachinko game sequence. For example, a video pachinko game sequence may consist of the following steps, 1) make wager (player), 2) select two or more balls for multiple game play (player), 3) initiate the two or more games (player) using a single input signal, 4) determine the game outcomes for the two or more games (gaming machine) and 5) present simultaneously the game outcomes for the two or more games (gaming machine). The wager for each game in the game sequence may be divided by the number of games initiated by the player or may be selected independently for each game. For example, when a player initiates 5 games in a game sequence, the wager on each game may be the total wager divided by 5 or the wager for each game may be different for each game. In the game sequence, as described above, the probability of each game outcome are calculated independently of one another even when the game outcome presentations appear to interact on the display screen 206.

For the pachinko game, multiple game outcome presentations in different stages may appear on the display screen at the same time. Thus, after being selected for a game play, two or more balls as described above, including ball "A" 202, ball "B" 208, ball "D" 214 or ball "F" 216, might appear to be falling from the top of the display screen to the bottom of the display screen 206 at the same time. The number of pachinko game outcome presentations appearing on the display screen at a given time may depend on a number of variables including 1) the length of time of each pachinko game outcome presentation, 2) the length of time a player uses to make a wager, to select a game and to initiate a game play and 3) in some cases the time required to input more money or credit of indicia into the gaming machine. For example, when a pachinko game outcome presentation is 5 seconds long for each game and a player initiates a new game every 0.5 seconds, up to 9 game outcome presentations in various stages may be presented on the display screen 206 at the same time. However, the length of each pachinko game outcome presentation or the time a player uses to initialize a new game is not fixed. Thus, the number of game outcome presentations on the display screen 206 may vary with time.

The game outcome presentations may appear to interact. For example, two balls may appear to collide altering the presented trajectory of each ball. However, although the multiple game outcome presentations may appear to interact the probability of the game outcome for each game is not affected by the game outcome presentation. Thus, the probability of each game outcome remains independent even when the game outcome presentations appear to interact on the display screen 206.

One advantage of this parallel pachinko game playing methodology is that the game throughput is not limited by the sequential presentation of the game outcome. The game throughput is the maximum number of games which may be played by a typical player on a gaming machine in a fixed period of time. For a pachinko game played on a gaming machine, a game may be initiated as soon as a player has made a wager, and selected a game. Thus, for pachinko game play, the number of games played in a fixed period time is limited by the time a player uses to initiate a new game and not by the presentation of the game outcome as is typically the case for sequential game play.

Another advantage of the parallel pachinko game playing methodology is that a player may be able to bet less per game and play many more games in a fixed period of time than when a sequential game playing methodology is used. This feature may add to the excitement of the game and lead to additional game play on the gaming machine. The size of the wagers in this scenario may be set to a level that encourages the player spend at least as much per unit time as he or she would in a conventional sequential game play methodology. Note that since the game throughput may be significantly higher for a parallel game than for a sequential game, the profitability of the gaming machine, which is the product of the game throughput times the average of wager per game, may be higher for a pachinko game played on a gaming machine than for other sequential games played on a gaming machine.

Figure 3:
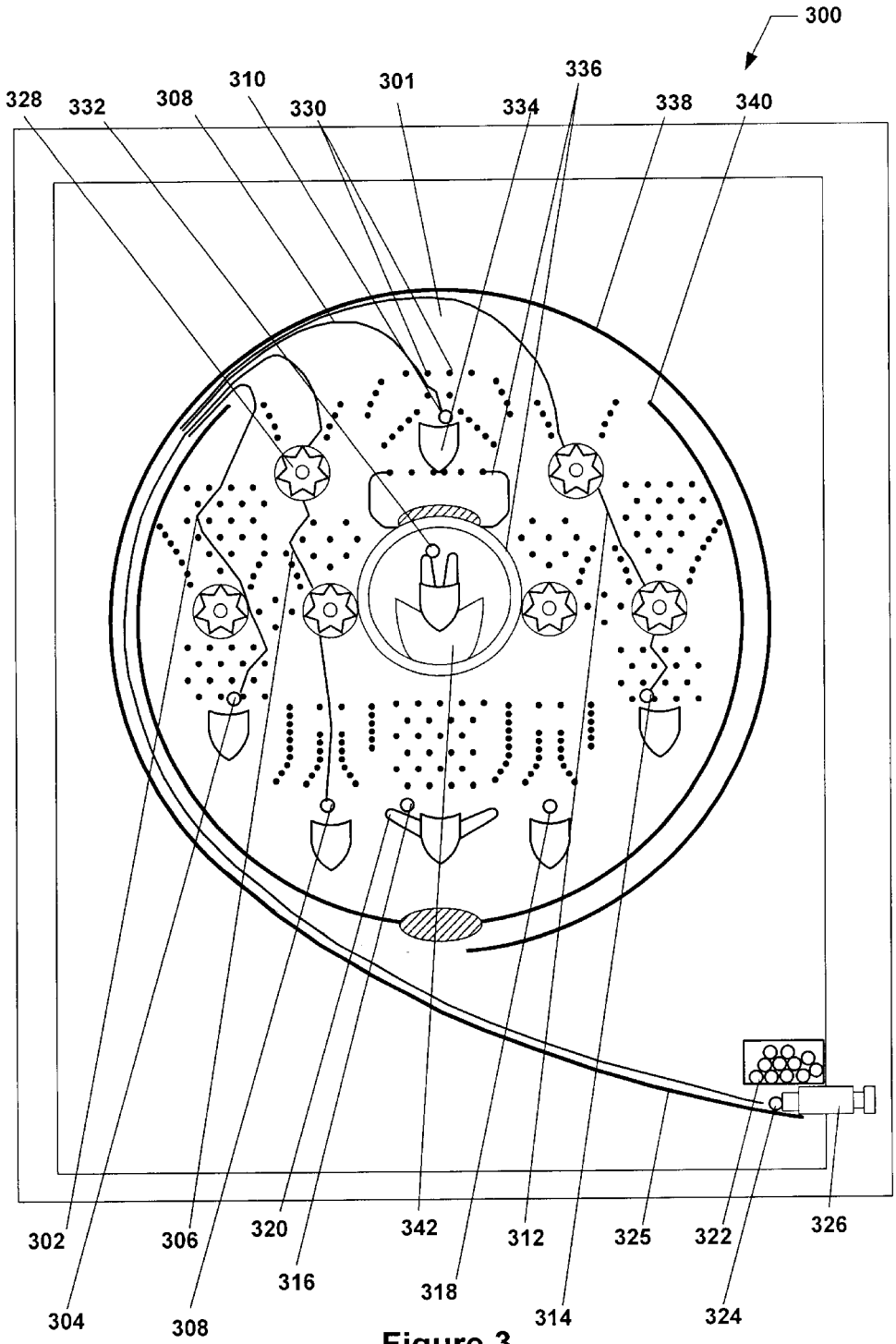
FIG. 3 is a block diagram depicting an example of a pachinko game being played on a gaming machine with a number of winning game outcome presentations.

FIG. 3 is a block diagram depicting an example of a pachinko game being played on a gaming machine with a number of distinct winning game outcome presentations. Pachinko game outcome presentations for winning games are shown on the video display screen 300. Typically, the video pachinko game outcome presentation on a video display screen 300 begins with a ball from the ball reservoir 322 being placed on a ramp 325 in front of the plunger 326. The number of balls in the ball reservoir may correspond to the number of credits a player has on the gaming machine. Further, the number of credits represented by each ball may not be the same. For example, each ball may be colored coded to represent a different wager amount. A silver ball might be worth 1 credit, a red ball might be worth 3 credits while a green ball might be worth 5 credits. The player may select a ball for a game from the ball reservoir using gaming machine inputs including input buttons or a touch screen.

After a player selects a ball representing a certain wager amount and initiates a game play, the gaming machine determines a game outcome and presents a compatible game outcome presentation. On the video display screen 300, the plunger 326 is drawn backward away from the ball 324 and then released. When the plunger 326 is released, it moves forward towards the ball 324 and appears to strike the ball 324. After being hit by the plunger 326, the ball 324 is launched up the ramp and into the game playing area 301. Typically, only one ball will be launched up the ramp at a time. However, two or more balls may be launched at the same time each ball representing a different game with an independently calculated game outcome.

In the game playing area 301, balls may appear to interact with different objects while falling through the game playing area 301 including pegs 330, an outer wall 340, an inner wall 338, flippers 320, bonus region separator 336, a cup 334, and a spinner 328. For example, when a ball appears to strike a peg, the trajectory of the ball is altered. Typically, a ball will appear to collide with many different combinations of objects before exiting the game playing area. The ball exit corresponds to the game outcome determined by the gaming machine. For example, when a ball exits the game playing area 301 through the ball exit 316, a player loses the wager on the game. When a ball exits the game playing area 301 through one of the 7 cups including the cup 314 or the bonus region exit 334, the game outcome is an award of some type.

Many other objects and exits are also possible with a pachinko game of this invention. These objects and exits may vary in size and location on the video display screen 300. Further, the distribution and number of objects on the video display screen 300 are not fixed and may be varied to change the game outcome presentation. However, as noted above, the game outcome presentation does not affect the determination of the game outcome by the gaming machine.

The game balls, including balls for game "A" 304, game "B" 308, game C "310", game "D" 314, game "E" 316, game "T" 318, game "G" 332, are near all of the exit locations corresponding to a winning game outcome presentation. In this embodiment, for any winning game outcome presentation, a ball will appear to exit through one of these exits. A number of trajectories through the game playing area including, 302, 306, 308, and 312, for games "A" 304, "B" 308, "C" 310 and "D" 314 are shown on the display screen 300. The trajectories represent the path of the ball through the game playing area 301 during a game outcome presentation. In a typical game outcome presentation, the trajectory path for a game, which is a line representing the position of the ball as a function of time, is not shown on the display screen 300.

During the game outcome presentation, the interaction of the ball with various objects on its trajectory and the uncertainty of the final destination of the ball adds to the excitement of the pachinko game. Many winning game outcome presentations are possible. For each winning game outcome presentation, the trajectory of the ball will start with the ball entering the game playing area 301 and end with a ball exiting at one of the seven cups including cup 334. In between the entering and exiting the game playing area 301, the ball appears to collide with a number of objects. The number of collisions along the trajectory is variable and may depend on the number of objects in the game playing area.

The game "A" 304, game "B" 308, game "C" 310, and game "D" 314 ball trajectories are a few examples of the many different possible winning game outcome presentations that are possible. Along the game "A" trajectory 302, after being launched up the ramp and entering the game playing area 301, the game "A" ball 304, appears to roll along the outer wall 340, collide with a number of pegs, collide with a spinner, and collide with a number of pegs. The game "A" ball exits the game playing area 301 through a cup, which corresponds to an award of some type. As described with reference to FIG. 2, the amount of the award may be indicated to the player by displaying a message of some type on the display screen and/or increasing the number of balls in the ball reservoir. The winning game "B", game "C" and game "D" trajectories (306, 308, 312) also end with a ball exiting the playing area through a cup followed by an award message of some type.

Along the game "B" trajectory 306, after being launched up the ramp and entering the game playing area 301, the game "B" ball 308, appears to roll along the outer wall 340, collide with a number of pegs, collide a spinner 328, collide with a number of pegs and exit the game playing area 301 via a cup. Along the game "C" trajectory 310, after being launched up the ramp and entering the game playing area 301, the game "C" ball 308, appears to roll along the outer wall 340, collide with a number of pegs and exit via the cup 334. Along the game "D" trajectory 312, after being launched up the ramp and entering the game playing area 301, the game "D" ball 314, appears to roll along the outer wall 340, collide with a number of pegs, collide with a spinner 328, collide with a number of pegs, collide with a second spinner and exit the game playing area 301 via a cup.

Using well-known physical relations, a realistic appearing trajectory for a ball in a game outcome presentation may be generated. To generate a trajectory, a ball with a particular density, size, and elasticity, is simulated falling, as being drawn by gravity, through a number of obstacles of a particular size and elasticity. As the ball collides with different objects while falling, the effects of the collisions on the trajectory of the ball are modeled. The number, location, and type of obstacles may correspond to the number, location, and type of obstacles on the display screen 300. The purpose of using the physical relations is to render a realistic presentation of a ball falling and colliding with various objects. The accuracy of the simulations is not important as long as it appears realistic or is appealing to a player playing a video pachinko game.

Ball trajectories for a game outcome presentation may be generated during the game outcome presentation or the trajectories may be generated ahead of time stored in a memory, and recalled during the game outcome presentation. When the trajectories are generated ahead of time, a large number of trajectories for various initial conditions may be generated and stored on a gaming machine in a memory of some type. Using a set of physical relations and a random number generator, a ball's trajectory through the game playing area is simulated. The random number generator is used to randomly determine an initial position and initial velocity for the ball. With the initial conditions for the ball and the locations of various objects, the trajectory of the ball is simulated through the game playing area until it reaches an exit. Using different randomly generated initial conditions each time, this process may be repeated many times until a sufficient database of trajectories is obtained. These trajectories may be grouped in the database according to the exit through which the ball left the game playing area.

When a game is initiated by the player and the game outcome is determined by the gaming machine, the gaming machine may randomly select a trajectory appropriate to the game outcome from a memory storing the trajectory database and utilize the trajectory in the game outcome presentation. For example, when the gaming machine determines a winning game outcome for a pachinko game, a winning trajectory stored in database including game "A" trajectory 302, game "B" trajectory 306, game "C" trajectory 308, and game "D" trajectory 312, may be recalled from the database and used as part of the game outcome presentation. The winning trajectory may be selected at random from all the stored trajectories in the database. With this method, the game outcome presentation does not affect the determination of the game outcome.

The size of the trajectory database is large enough so that the game outcome presentations appear random to a player playing multiple games on the gaming machine. When the trajectory database is too small, a player playing multiple pachinko games in succession might notice some trajectories repeating during the game outcome presentations of successive games. When a player notices the game outcome presentations repeating, the player may lose interest in playing the game.

All of the simulation parameters used in the generation of the game outcome trajectories do not have to be identical for each game. To add excitement to the game, the apparent density, size and elasticity of the balls and the gravitational constant may be varied. For example, by increasing the elasticity of the balls in the simulation of the ball's trajectory, the balls appear to bounce more when colliding with objects. As another example, by increasing the gravitational constant in the trajectory simulation for a particular ball, the ball would appear to fall at a faster rate than a ball with a lower gravitational constant. As described in the previous paragraph, trajectories using various simulations parameters may be generated ahead of time and stored in a trajectory database before game play begins. Again, the trajectories may be grouped in the database according to which exit the ball left the game playing area during the simulation. During game play, these trajectories may be recalled from a memory on the gaming machine and used as part of the game outcome presentation.

For trajectories generated with identical simulation parameters, the length of the game outcome presentation is proportional to the length of the trajectory. On the display screen 300, the lengths of the game "A" 304, game "B" 308, game "C" 310, and game "D" 314 trajectories in order from shortest to longest are the game "C" trajectory 308, the game "A" trajectory 302, the game "B" trajectory 306 and the game "D" trajectory 312. Hence, when identical simulation parameters are used to generate the game A, B, C, and D trajectories, the length of the game outcome presentations in order from shortest to longest are the game "C" trajectory 308, the game "A" trajectory 302, the game "B" trajectory 306 and the game "D" trajectory 312. When different simulation parameters are used to generate the trajectories, the length of the game outcome presentation may not be proportional to the length of the trajectory. For example, when a gravitational constant is used for trajectory "D" 312 which is much higher than the gravitational constant used for trajectory "C" 308, the length of the game outcome presentation for trajectory "D" 312 may be shorter than trajectory "C" 308 although the length of trajectory "C" 308 is shorter than the length of trajectory "D" 312.

In some embodiments, the game outcome presentations may be affected by player inputs. For example, after making a wager, a player may select a gravitational constant for the ball trajectories in the game outcome presentations. When gravitational constant selected by the player is large, the game outcome presentations are faster. When the gravitational constant selected by the player is small, the game out presentations are slower. Thus, a player may be given the option of selecting a faster or slower game outcome presentation speed to suit their individual preference. In one embodiment, the gravitational constant selected by the player may be used in the simulation of the game outcome presentation during game play. In another embodiment, the gravitational constant selected by the player may be used to recall a trajectory with a similar gravitational constant from a trajectory database generated ahead of time. As another example, a player may be able to select combinations of the size, density or elasticity of the balls used in the game outcome presentations. However, as described above, player input selections do not affect the determination of the game outcome but may affect the game outcome presentation.

In another embodiment, a player may affect the game outcome presentation using the plunger 326. As described previously with reference to FIG. 3, to initiate the game outcome presentation, the plunger 326 on the display screen 300 is drawn backwards and then released appearing to strike the ball 324 and launch it into the game playing area 301. Game inputs including a touch screen or input buttons may be used to allow a player to control the distance the plunger 326 appears to be drawn backwards away from the ball 324 before it is released. When the plunger 326 is drawn back farther away from the ball 324, the plunger appears to strike the ball with more force. When the plunger 326 is closer to the ball 324 before it is released, the plunger appears to strike the ball with less force.

The force the plunger appears to strike the ball may appear to affect the game outcome presentation. In general, the distance a ball rolls along the outer wall 340 is proportional to the distance the plunger 326 is drawn away from the ball. In the game outcome presentation, as the distance the plunger 326 is drawn away from the ball is increased, the distance the ball rolls along the outer wall 340 before entering the game playing area 301 is increased. For example, when the player uses the game inputs to draw the plunger a large distance from the ball, a trajectory similar to the game "D" trajectory 312 may be used in the game outcome presentation. When the player used the game inputs to draw the plunger a short distance from the ball, a trajectory similar to the game "A" trajectory 302 may be used in the game outcome presentation.

The distance a player appears to draw the plunger backwards from the ball ay be used as part of a real-time trajectory simulation for the game outcome presentation or the distance may be used to select a trajectory for the game outcome presentation from a trajectory database generated ahead of time. For example, using a trajectory database, when a player draws the plunger backwards a large distance away from the ball and a winning game outcome is determined by the computer, a trajectory, similar to game "D" 312, maybe selected from the trajectory database to be used in the game outcome presentation.

As described with Reference to FIG. 2, for the video pachinko game, multiple game outcome presentations in different stages may appear on the display screen 300 at the same time and the game outcome presentations may appear to interact. For example, game "G" ball 332 is in the bonus region 342 bounded by the bonus region separator 336. When the ball for game "G" 332 enters the cup in the bonus region, the flipper 320 may close when it is open or the flipper 320 may open when it is closed for subsequent game outcome presentations. When the flipper 320 is open for subsequent games, the gaming machine may utilize with a higher frequency ball trajectories in the game outcome presentations where a ball including game "F" 318 hits the flipper and is drawn into the cup connected to the flipper. To the player, it may appear that the probability of this winning game outcome has increased. However, although the multiple game outcome presentations may appear to interact the probability of the game outcome for each game is not affected by the game outcome presentation. Thus, the probability of each game outcome remains independent even when the game outcome presentations appear to interact on the display screen 300.

Figure 4:
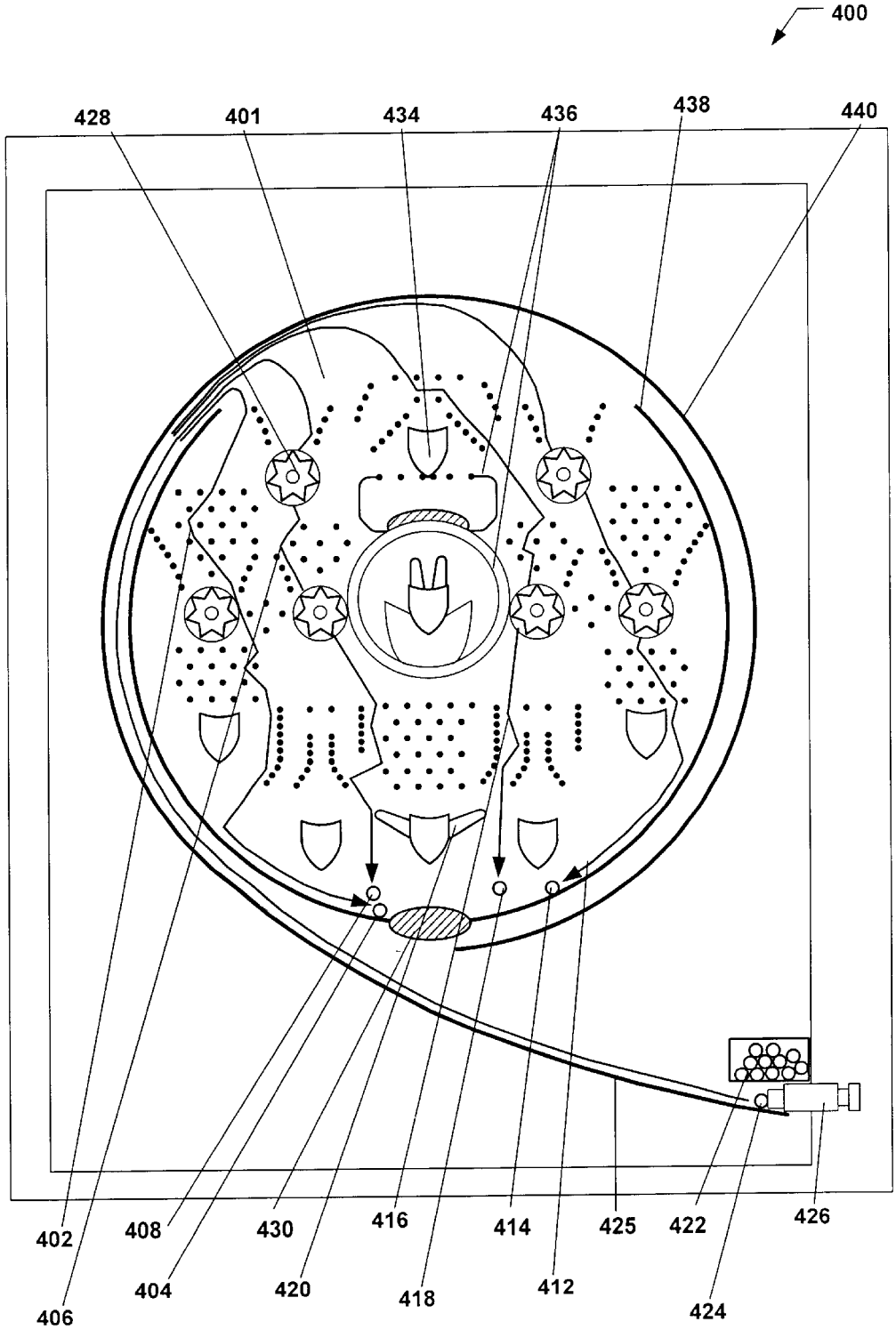
FIG. 4 is a block diagram depicting an example of a pachinko game being played on a gaming machine with a number of losing game outcome presentations.

FIG. 4 is a block diagram depicting an example of a pachinko game being played on a gaming machine with a number of losing game outcome presentations. After a player selects a ball representing a certain wager amount and initiates a game play. The gaming machine determines a game outcome and presents a compatible game outcome presentation. Pachinko game outcome presentations for losing outcomes are shown on the video display screen 300.

As described with reference to FIG. 3, on the video display screen 400, the plunger 426 is drawn backward away from the ball 424 and then released. When the plunger 426 is released, it moves forward towards the ball 424 and appears to strike the ball 424. After being hit by the plunger 426, the ball 424 is launched up the ramp and into the game playing area 401. In the game playing area 401, balls may appear to interact with different objects while falling through the game playing area 401 including pegs 430, an outer wall 440, an inner wall 438, flippers 420, bonus region separator 436, a cup 434, and a spinner 428. For example, when a ball appears to strike a peg, the trajectory of the ball is altered. Typically, a ball will appear to collide with many different combinations of objects before exiting the game playing area. For a losing game outcome presentation, a ball exits the game playing area 401 through the exit 430 at the bottom of the game playing area.

The game balls, including balls for game "A" 404, game "B" 408, game C "418" and game "D" 414, are near all of the exit location 430 corresponding to a losing game outcome presentation. In one embodiment, for any losing game outcome presentation, a ball will appear to leave the game playing area 401 through the ball exit 430. A number of trajectories through the game playing area, including, 402, 406, 416, and 414, for games "A" 404, "B" 408, "C" 418 and "D" 414 are shown. The trajectories represent the path of the ball through the game playing area 401 for a losing game outcome presentation. In a typical losing game outcome presentation, the trajectory path for a game, which is a line representing the position of the ball as a function of time is not shown on the display screen 400.

During the game outcome presentation, the interaction of the ball with various objects on its trajectory and the uncertainty of the final destination of the ball adds to the excitement of the pachinko game. Many losing game outcome presentations are possible. For each losing game outcome presentation, the trajectory of the ball will start with the ball entering the game playing area 401 and end with a ball exiting at the ball exit 430. In between the entering and exiting the game playing area 401, the ball appears to collide with a number of objects. The number of collisions along the trajectory is variable and may depend on the number of objects in the game playing area.

The game "A" 404, game "B" 408, game "C" 418, and game "D" 414 ball trajectories are a few examples of the many different possible losing game outcome presentations that are possible. Along the game "A" trajectory 402, after being launched up the ramp and entering the game playing area 401, the game "A" ball 404, appears to roll along the outer wall 440, to collide with a number of pegs, collide with a spinner, collide with a number of pegs and then roll along the inner wall 438. The game "A" ball exits the game playing area 401 through the ball exit 430, which corresponds to a loss of wager on the game. As described with reference to FIG. 2, the loss of the wager may be indicated to the player by displaying a message of some type on the display screen 400. The losing game "B", game "C" and game "D" trajectories (406, 416, 412) also end with a ball exiting the playing area through the ball exit 430 which may be followed by a loss of wager message of some type.

Along the game "B" trajectory 406, after being launched up the ramp and entering the game playing area 401, the game "B" ball 408, appears to roll along the outer wall 440, collide with a number of pegs, collide with a spinner 428, collide with a number of pegs, collide with another spinner, collide with a number of pegs, collide with the side of a flipper 420, roll along the inner wall 438 and exit the game playing area 401 via the ball exit 430. Along the game "C" trajectory 416, after being launched up the ramp and entering the game playing area 401, the game "C" ball 418, appears to roll along the outer wall 440, collide with a number of pegs, collide with a spinner, a number of pegs, roll along the inner wall 438 and exits via the ball exit 430. Along the game "D" trajectory 412, after being launched up the ramp and entering the game playing area 401, the game "D" ball 414, appears to roll along the outer wall 440 collide with a number of pegs, collide with a spinner, collide with a number of pegs, collide with a second spinner, collide with a number of pegs, collide with the side of a cup, roll along the inner wall 438 and exit the game playing area 401 via the ball exit 430.

For the different pachinko games, many different losing game outcome presentations are possible and are not limited to the examples described above. The same methods described in reference to FIG. 3 in regards to the generation of the game trajectories, their utilization in a game outcome presentations, and potential player interaction affecting a game outcome presentation are used for the losing outcome game presentation. Further, many different combinations of game outcome presentations are possible. For example, both losing and winning game outcome may be presented simultaneously.

Figure 5B:
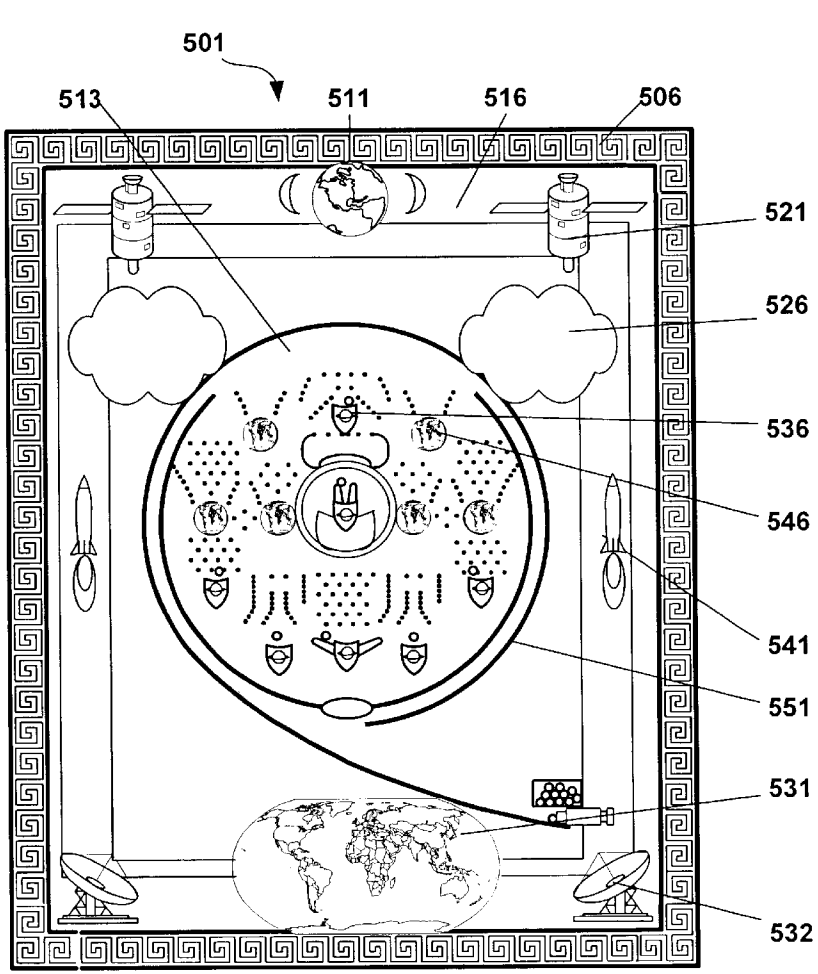
FIGS. 5A and 5B are block diagrams of gaming machine display screens depicting a different game outcome presentation backgrounds.
Figure 5A:
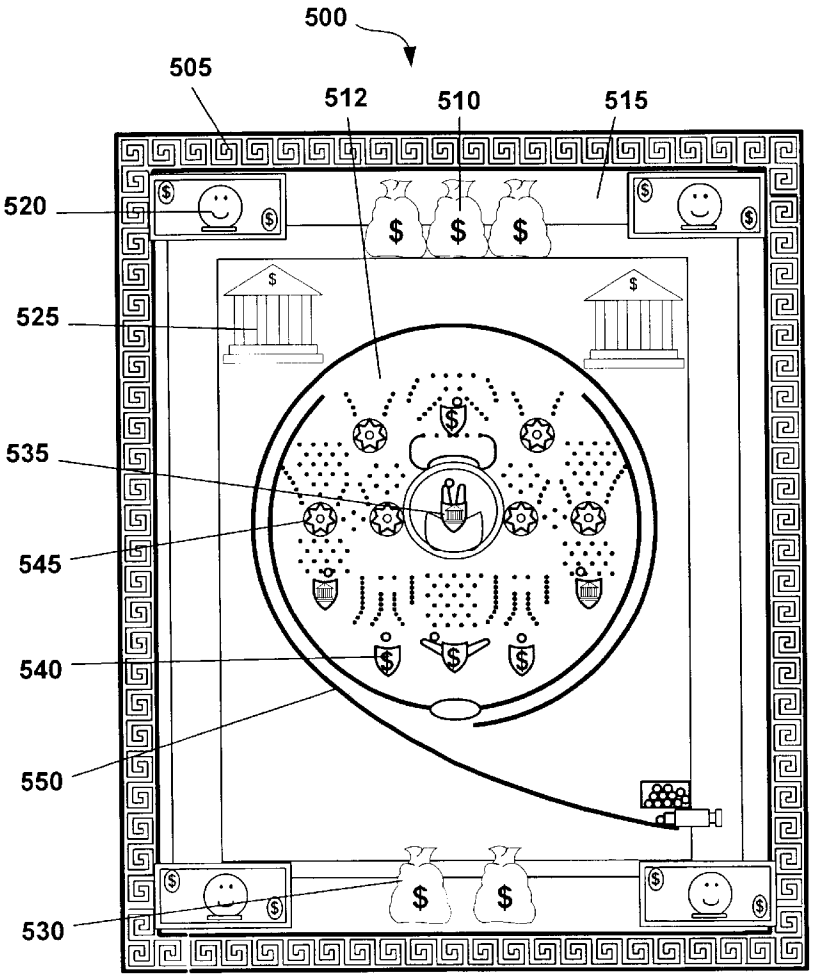
Figure 6A:
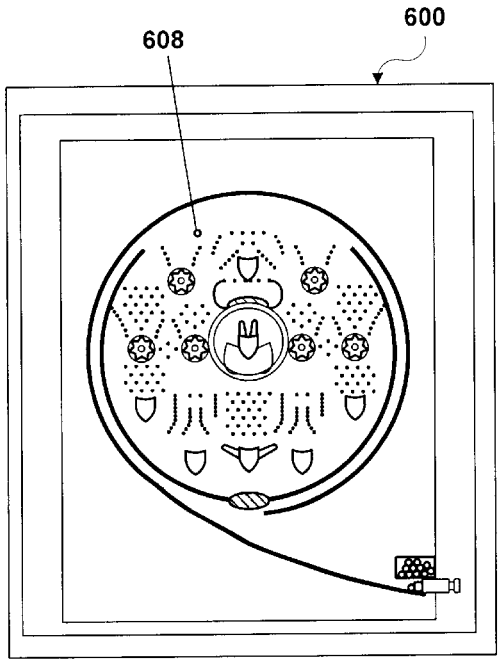
FIGS. 6A, 6B, 6C, and 6D are block diagrams of gaming machine display screens depicting a sequence of pachinko game play.
Figure 6B:
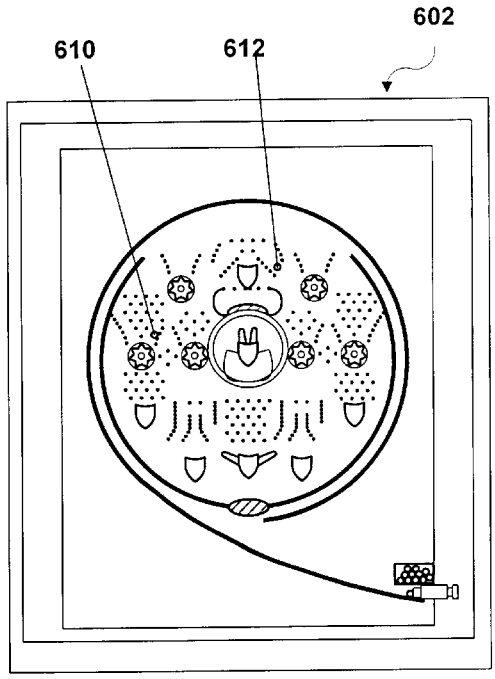
Figure 6C:
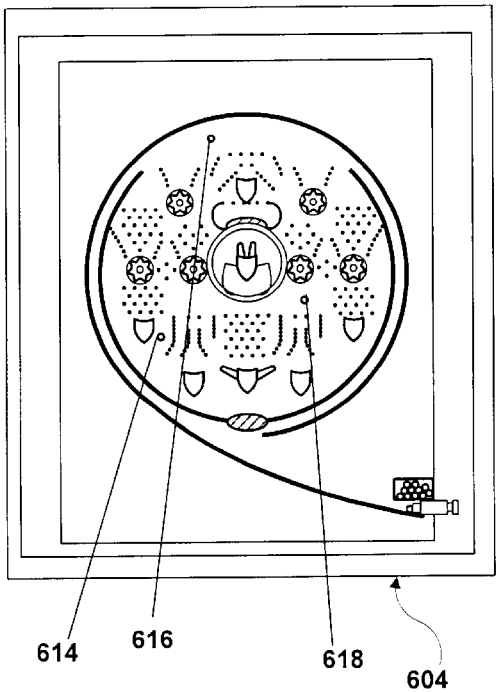
Figure 6D:
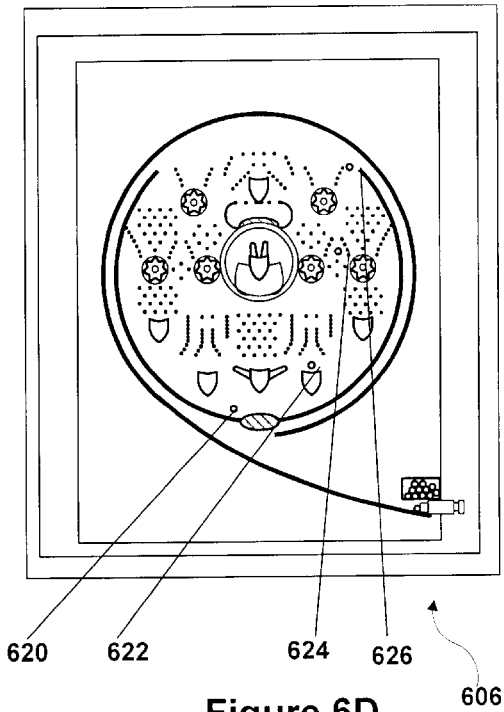

FIGS. 5A and 5B are block diagrams of gaming machine display screens depicting different game outcome presentation backgrounds. Often the amount of a game play on particular gaming machine is related to the artwork and theme incorporated as part of the gaming machine. A gaming machine, as described with reference to FIGS. 1 and 2, may include artwork according to a particular theme painted on the sides of the gaming machine, on the belly glass, around the display screen and on the front and sides of the top box. For example, when the theme is cars, the gaming machine may include artwork at various locations on the gaming machine relating to cars. Further, the gaming machine may project car noises during the game as part of the car theme.

In FIG. 5A, a pachinko game is shown on a display screen 500. The edge of the display screen is a decorative border 505. On the display screen 500, the pachinko game playing area 512 is bounded by the outer wall. The game outcome presentations as described with reference to FIGS. 2, 3 and 4 are presented in the game playing area 512. Between the outer wall 550 and the border 505 is a background 515. The background includes a theme 510, which is money, and a number of background objects including money 520, banks 525, money bags 530. The background objects add to the visual presentation of the game, which may attract players to play a game on the gaming machine. To enhance the visual presentation of the pachinko game, objects within the game playing area 512 may also include decorations. For example, three cups include a bank decoration 535 while four of the cups include a dollar sign 540 as a decoration. Each of the spinners in the game playing area 512 include a seven-pointed star as a decoration.

To suit player preferences for pachinko game themes, the background objects and decorative objects in the game playing area may be easily changed. For a particular pachinko game layout, different game background patterns may be stored in a memory on the gaming machine. The layout is the number and distribution of objects on the display screen. To change the game theme, these game background patterns may be recalled by a game player or a gaming machine operator. For example, in FIG. 5B, a display screen 501 displays a pachinko game with a space theme 511. The display screen 501 includes the same border pattern 506 as border 505 in FIG. 5A. However, in general, for different themes, the border 506 may be altered. The space theme utilizes various objects in the background including a satellite 521, a cloud 526, a rocket 541, a map of the world 531 and a satellite dish 532. The spinners and cups in the game playing area 513 are also decorated according to the space theme 511. The spinners are decorated with a map 546 and the cups are decorated with a picture of Saturn 536.

In FIGS. 5A and 5B, the layout of the pachinko games is similar in that the number of objects and distribution of objects in the game playing areas 512 and 513 are identical. Typically, when the layouts in the game playing areas for two pachinko games are similar, the game outcome presentations, which includes balls colliding with objects in the game playing area, are similar. However, the pay tables, which contains the probability of each potential game outcome occurring, may differ. For example, the probability of a losing game outcome for the pachinko game on display screen 500 may be greater than the probability of losing for the pachinko game on display screen 501. Further, the gaming machine may store multiple pachinko games with different background patterns and game layouts that utilize different pay tables. However, only a gaming machine operator is allowed to change the pay table for a particular game.

FIGS. 6A, 6B, 6C, and 6D are block diagrams of gaming machine display screens depicting a sequence of pachinko game play. Specifically, FIGS. 6A, 6B, 6C, and 6D represent a sequence of game play by a player on the gaming machine where each figure is the display screen on the gaming machine at a different time. The sequence of game play for each of the pictures may be in any order. For example, a player may begin game play on the gaming machine by initiating a pachinko game "A1" 608. In one embodiment, the pachinko game "A1" 608 on the display screen 600 is the pachinko game outcome presentation at a time t1. At a time later than t1, the ball game "A1" 601 exits the game playing area and a game outcome message may be displayed.

At some time later than t1, a player may initiate a second game on the gaming machine while the game outcome presentation of the first pachinko game "A1" 608 is still being presented. Thus, a player may initiate another pachinko game "B2" 612 while the outcome from the first pachinko game is being presented. At a time t2 which is later than t1, the pachinko game "B1" presentation 610 and the pachinko game "B2" 612 presentation are displayed on the display screen "B" 602 at the same time. In this game playing sequence, the pachinko game "B1" 610 at time t2 is a continuation of the game outcome presentation from game "A1" 608 at time t1. While playing the pachinko game "B2" 612 and the pachinko game "B1" 610, player may alternate his or her attention in any order between the pachinko game "B1" and the pachinko game "B2". However, as described in reference to FIGS. 2, 3 and 4, the game outcome for the pachinko game "B2" 612 is independent of the game outcome determined for the pachinko game "B1" 610.

At some time later than t2, a player may initiate a third game on the gaming machine while the game outcome presentations of the first pachinko game "B1" 610 and the second pachinko game "B2" 612 are still being presented. Thus, a player may initiate a third pachinko game "C3" 618 while the outcomes from the first two pachinko games are being presented. At a time t3 which is later than t1 and t2, the pachinko game "C1" presentation 614, the pachinko game "C2" presentation 616 and the pachinko game "C3" 618 presentation are displayed on the display screen "C" 604 at the same time. In this game playing sequence, the pachinko game "C1" 614 at time t3 is a continuation of the game outcome presentation from game "B1" 610 at time t2 and the pachinko game "C2" 616 at time t3 is a continuation of the game outcome presentation from game "B2" 612 at time t2. While playing the pachinko games "C1" 614, "C2" 616 and "C3" 618, the player may alternate their attention in any order between the pachinko games "C1", "C2" and "C3." One reason for allowing a multiple game outcome presentation is that a player may enjoy watching multiple games simultaneously better than watching one pachinko game at a time.

At some time later than t3, a player may initiate a fourth game on the gaming machine while the game outcome presentations of the first pachinko game "C1" 610, the second pachinko game "C2" 616 and the third pachinko game "C3" 618 are still being presented. Thus, a player may initiate a fourth pachinko game "D4" 626 while the outcomes from the first three pachinko games are being presented. At a time t4 which is later than t1, t2, and t3, the pachinko game "D1" presentation 620, the pachinko game "D2" presentation 622, the pachinko game "D3" 624 presentation and the pachinko game "D4" presentation 626 are displayed on the display screen "D" 606 at the same time. In this game playing sequence, the pachinko game "D1" 614 at time t4 is a continuation of the game outcome presentation from game "C1" 614 at time t3, the pachinko game "D2" 622 at time t4 is a continuation of the game outcome presentation from game "C2" 616 at time t3, and the pachinko game "D3" 624 at time t4 is a continuation of the game outcome presentation from game "C3" 618 at time t3. On the display screen 606, the game "D1" ball 620 is near an exit. After a game ball exits the game playing area and a game outcome message is displayed, the game is no longer a part of the current game outcome presentation. While playing the pachinko games "D1" 620, "D2" 622, "D3" 624 and "D4" 626, the player may alternate their attention in any order between the pachinko games "D1", "D2", "D3" and "D4."

In the game playing sequence just described at the times t1, t2, t3 and t4, potential game awards or bonus features may be triggered when the sum of the wagers represented by all the balls in a multiple game outcome presentation is above a certain amount. For example, a player may only be able to win a jackpot, which is the maximum award payout on a gaming machine, when the sum of the wagers represented by all the balls is greater than or equal to 5 credits. Thus, in FIG. 6A, at time t1, a player may win a jackpot when the amount wagered on game A1 608 is 5 or more credits. As another example, in FIG. 6B at time t2, a player may have wagered 3 credits on game "B1" 610. When the player wagers 2 or more credits on game "B2" 612, a jackpot may be awarded for game "B2" because the sum of the wagers of the games "B1" 610 and "B2" 612 in the multiple game outcome presentation is greater than 5 credits. When the player wagers only 1 credit on game "B2", a jackpot may not be awarded for game "B2" because the sum of the wagers of the games "B1" 610 and "B2" 612 in the multiple game outcome is less than 5 credits.

In general, an award feature or bonus feature may be awarded for a particular game when the sum of the wagers of the all games in multiple game outcome presentation is greater than a certain amount. In a multiple game outcome presentation, a pachinko ball is part of the presentation until it exits the game playing area of the pachinko game. Thus, for determining an award or bonus feature for a new game, the sum of the wagers is based on the sum of the wagers from all the balls in the game playing area when the new game is initiated. As another example, the possibility of a bonus feature or award feature may be activated when the number of balls in a multiple game outcome presentation is greater than a certain amount. For example, the possibility of a bonus feature such as a flipper opening in the game outcome presentation may be activated when the number of balls on the screen is four or more balls. Thus, in FIG. 6D, a bonus feature in the game outcome presentation may be activated when game "D4" is initiated. This type of award or bonus scenario may apply to any game playing sequence comprised of one or more game outcome presentation being presented simultaneously. In one embodiment, a bonus feature may allow a player a chance at winning a progressive or wide area progressive prize. An advantage of this award or bonus feature methodology is that it may encourage faster game play on the gaming machine.

As another example of a pachinko game playing sequence, at a time t1, a player may be playing the pachinko game on display screen "C" 604 with a multiple game outcome presentation consisting of games "C1" 614, "C2" 616, and game "C3" 618. The player may decide to initiate an additional game. Thus, at a time t2 which is later than t1, a player may be playing the pachinko game on display screen "D" 606 with a multiple game outcome presentation consisting of games "D1" 620, "D2" 622 "D3" 624, "D4" 626. Next, a player may initiate a new game after all the game outcome presentations for games "D1" 620, "D2" 622 "D3" 624, "D4" 626 are complete. Thus, at a time t3 which is later than t1 and t2, a player may be playing only the pachinko game "A1" on the display screen "A" 600. Then, the player may again decide to initiate an additional game. Thus, at a time t4 which is later than t1, t2, and t3, a player may decide to play the pachinko game on the display screen "B" 602 with a multiple game outcome presentation consisting of games "B1" 610 and "B2" 612.

Figure 7A:
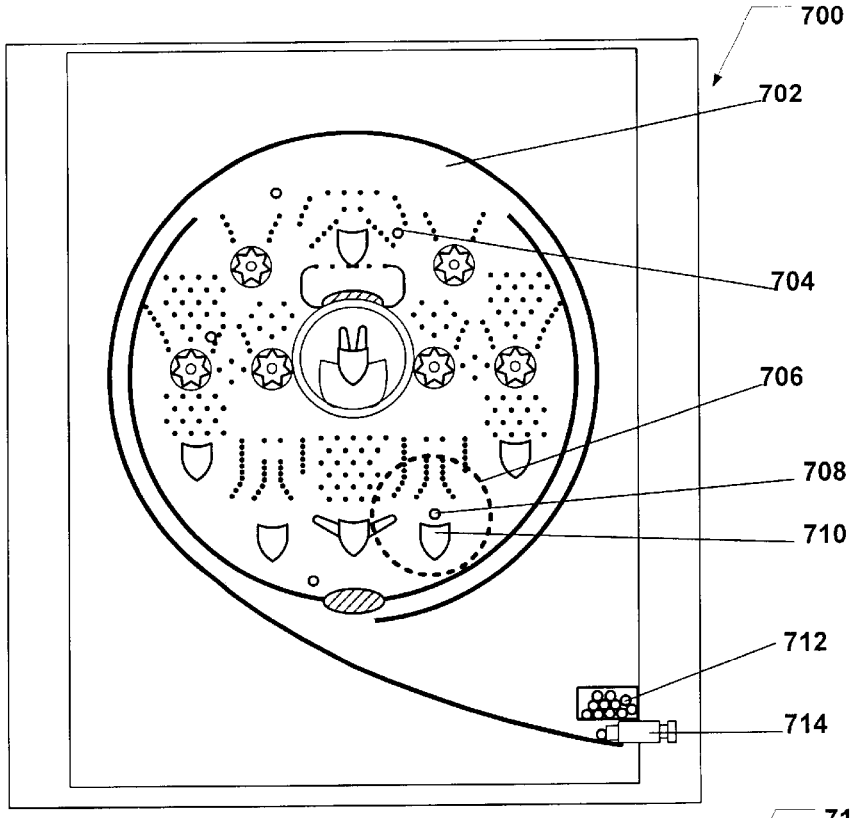
FIGS. 7A and 7B are block diagrams of gaming machine display screens depicting a parallel video pachinko game with a bonus game option.
Figure 7B:
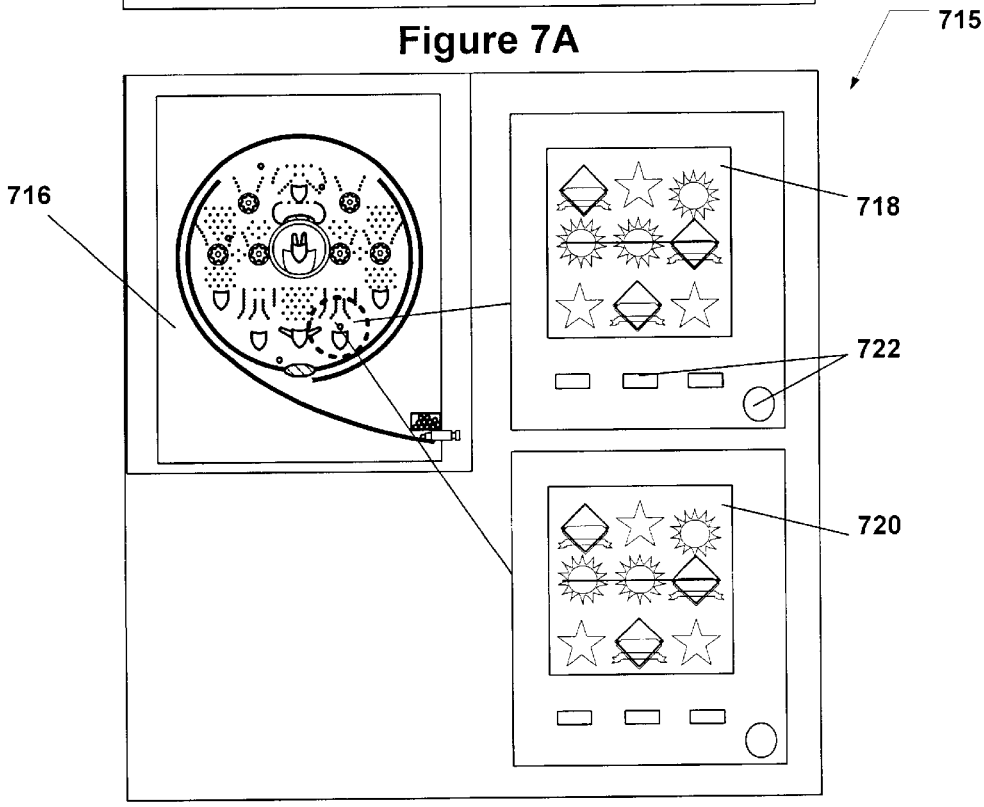

FIGS. 7A and 7B are block diagrams of gaming machine display screens depicting a parallel video pachinko game with a bonus game option. As described with reference to FIGS. 2, 3, and 4, a video pachinko game may be initiated when a player selects a ball from the ball reservoir 712 on the game display 700. Then, the gaming machine determines a game outcome and the game outcome is presented to the player on the display screen 700. The game outcome presentation begins with a ball being propelled by the plunger 714 into the game playing area 702. With the video pachinko game, multiple game outcome presentations may be presented simultaneously. For example, the outcomes of a game "A" 704 and a game "B" 707 are shown on the display screen 700. When a ball enters one of the seven cups including 710, the player typically receives an award of some type. The amount of the award is usually variable and is based on a pay table stored within the gaming machine.

In one embodiment of this invention, the presentation of an award including a progressive award may be made via a bonus game. For example, during a pachinko game, a cup 710 may be identified as a bonus area by a delimiter of some type including the dashed circle 706. When a ball including game "B" 708 enters a cup 710 within a bonus game area 700, one or more bonus games may be presented to the player. The outcome of the bonus game corresponds to a predetermined award by the gaming machine for game "B" 708 and is an additional game outcome presentation for game "B" 708.

In another embodiment of this invention, when the ball including game "B" 708 enters the cup 710 within the bonus game area 700, the player may be provided an additional game play opportunity. The additional game play opportunity may be a different game with a game outcome and a game outcome presentation independent from the first game. For example, after a ball enters the cup 710 in the bonus game area 700, a player may be presented an award and then a slot game may appear on the display screen. A player may be offered the opportunity to bet all or a portion of the award on the slot game. When a player makes a wager and initiates the slot game, the gaming machine determines a game outcome for the slot game and presents the game outcome to the player on the display screen.

In FIG. 7B, a video pachinko game outcome presentation 716 with a bonus slot game "A" presentation 718 and a bonus slot game "B" 720 presentation on the game display 714 is shown. The bonus games, 718 and 720, may be initiated when a ball enters a cup 710 in the bonus game area 706. As another example, a bonus game may be triggered when a ball appears to hit a particular object. For example, the bonus games, 718 and 720, maybe initiated when a ball hits the cup 710 in the bonus game area 706. With the parallel game playing methodology, a player may continue to play the game that triggered the bonus game while the one or more bonus games are presented. For example, a player may continue to play the video pachinko game 716 while the outcomes of the bonus slot game "A" 718 and the bonus slot game "B" 720 are presented. Further, a player may make additional game decisions on the bonus game while the game that spawned the bonus game is being presented. For example, while the video pachinko game 716 is being presented, a player may make an additional wager and initiate a slot game "A" presentation 718 using the slot game player inputs 722. The combinations of the video pachinko game and the slot game are only one embodiment of the present invention. Many different games with various bonus games presentations are possible. For example, other games that may be used as a bonus game include black jack, poker, keno and pachinko.

Typically, a bonus game is triggered when a pachinko ball exits the game playing area from a particular exit. Usually, bonus games are only triggered when a ball exits one of the exits corresponding to an award of some type including a progressive award. The probability of the presentation of a bonus game is stored within a memory located on the gaming machine. As described with reference to FIG. 6, the probability of a bonus game may be a function of the number of balls in a multiple game outcome presentation or sum of the wagers of all the balls in a multiple game outcome presentation. Further, a bonus game may be triggered at random based on probabilities stored in memory. Using a random number generator and the probability stored in memory, the gaming machine calculates when a bonus game outcome presentation is to be presented to the player.

Figure 8:
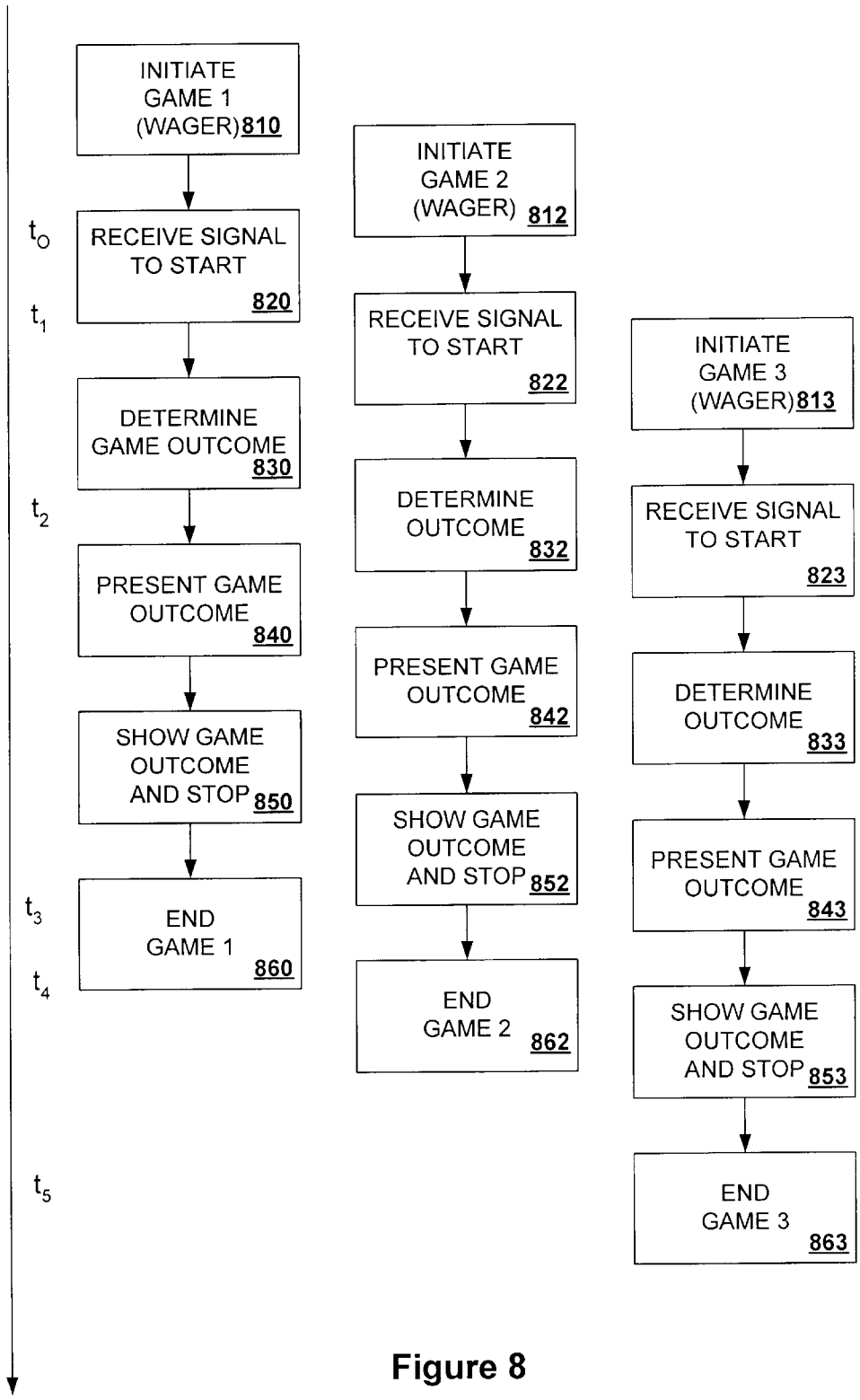
FIG. 8 is a flow chart depicting a parallel game playing methodology on a gaming machine.

FIG. 8 is a flow chart depicting a parallel pachinko game playing methodology on a gaming machine. In the flow chart, a timeline of game play is shown for three different games being played on a single gaming machine. In steps 810, 812, and 813, a player initiates game play on the gaming machine by making a wager. The wager for each game may be different. As described with reference to FIGS. 2 and 3, a game outcome presentation on the gaming machine is initiated after a player makes a wager and then the player activates an input device on the gaming machine.

In steps 820, 822, and 823, the game play is activated on the gaming machine after receiving a start signal from an input device on the gaming machine. The input signals are received by the gaming machine at different times. The start signal for game 1 is received at t1, the start signal for game 2 is received at t2, and the start signal for game 3 is received at t3 where t3 is after t1 and t2 and t2 is after t1. The difference in time between t1 and t2 or t2 and t3 depends on the length of time used by the player to initiate each game.

In steps 830, 832, and 833, the master gaming controller on the gaming machine determines a game outcome for each game. The outcome for each game is determined independently for each game. Thus, outcome of one game does not affect the outcome of another game. In steps, 840, 842, and 843, the game outcome is presented to the player. The type of game outcome presentation may vary depending on the type of games features available for play on the gaming machine. Further, the game outcome presentations may overlap. Thus, a player may view the game outcomes from multiple games at the same time. In steps 850, 852, 853, the game outcome is displayed for each game and the game is stopped. The game outcome, which is the end of the game outcome presentation, is usually a message displayed on some manner on the gaming machine indicating an award of some type or a loss of the wager made on the game.

The amount wagered on a previous game during a particular time period or the number of games being played during a particular time period may affect the outcome of another game. For example, at time t2 games 1 and 2 have already been initiated when game 3 is initiated but games 1 and 2 have not ended. Thus, at time t2, games 1, 2, and 3 comprise a multiple game outcome presentation. Therefore, the sum of the amounts wagered on games 1, 2, 3 may trigger a bonus feature or award feature when the sum is greater than a certain amount. This sum may be utilized when the outcome for game 3 is determined in step 833.

In steps, 860, 862, and 863, each of the three games is ended. The end of game 1 is at time t3, the end of game 2 is at time t4, and the end of game three is at time t5 where t4 is after t3 and t5 is after t3 and t4. The end times for each game are not limited to the sequence in the figure. For example, game 3 may end before game 2 and game 1 although game 1 and game 2 are initiated before game 3. As another example, game 2 may end before game 1 and game 3. The end time for each game depends on the length of the game outcome presentation of each game and the time a player may use to make any needed game decisions for the game. Thus, in a sequence of games being played in parallel on the gaming machine, the length of time between the start of the game and the end of the game may vary from game to game.

Figure 9:
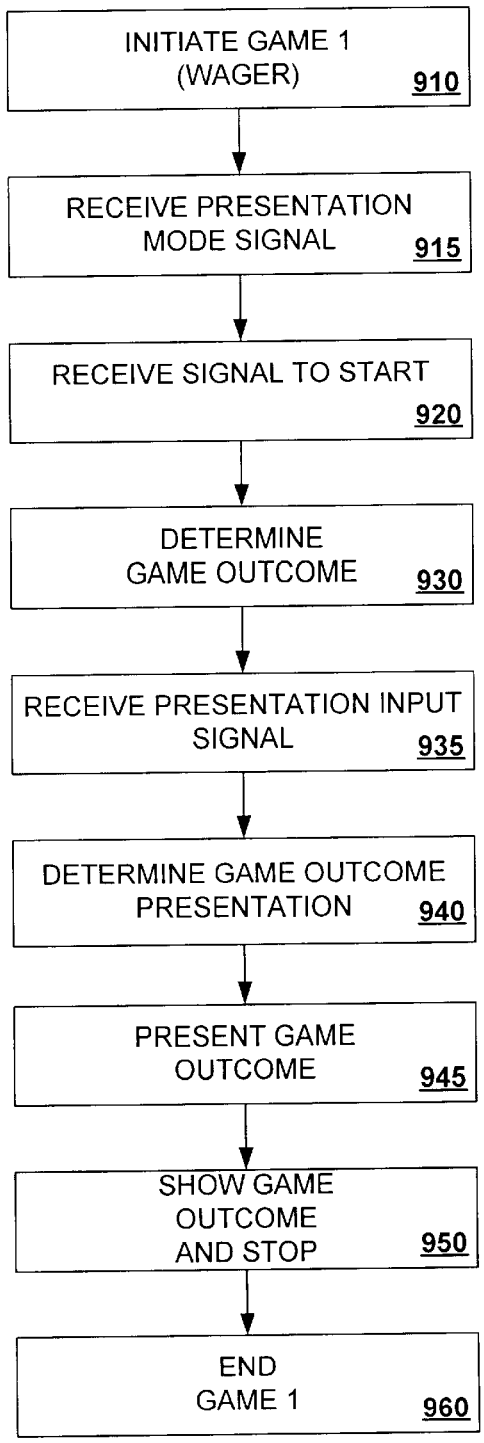
FIG. 9 is a flow chart depicting a pachinko game outcome presentation methodology on a gaming machine.

FIG. 9 is a flow chart depicting a pachinko game outcome presentation methodology on a gaming machine. In step 910, a player initiates a game by making a wager. In step 915, the gaming machine receives a presentation mode signal from the ball. This presentation mode signal might carry information regarding selections by the player for one or more of the following game inputs including game speed, game background pattern, elasticity of the game balls, size of the game balls or the game layout. The gaming machine uses the presentation mode signal to determine features of the game outcome presentation to be presented to the player. In step 920, the gaming machine receives a signal to start the game. In step 930, the gaming machine determines a game outcome using a random number generator and a pay table stored within a memory in the gaming machine. The game outcome may be affected by the wager the player has made on this game and previous games or the number of game outcome presentation being presented.

In step 935, the gaming machine may receive a game presentation input signal. This signal may be used to determine the features of a game outcome presentation. For example, a game presentation input signal received by the gaming machine may contain information regarding the distance a player has moved a plunger away from a pachinko ball on a display screen. As described with reference to FIG. 3, this distance may be used to generate or select a trajectory for a game outcome presentation. In step 940, the gaming machine determines the game outcome presentation. The features of the game outcome presentation may depend on information from the presentation mode signal from step 915, the game outcome determined by the gaming machine in step 930, the information received from the presentation input signal in step 935 and information from previous game outcome presentations currently being presented on the display screen.

In step 945, after calculating an appropriate game outcome presentation for game 1, the game outcome presentation is displayed on a display screen to the player. In step 950, the game outcome is displayed on the display screen. The game outcome may be a message of some type containing information regarding whether the outcome of the game is an award of some amount or loss of the wager made on the game.

Figure 10:
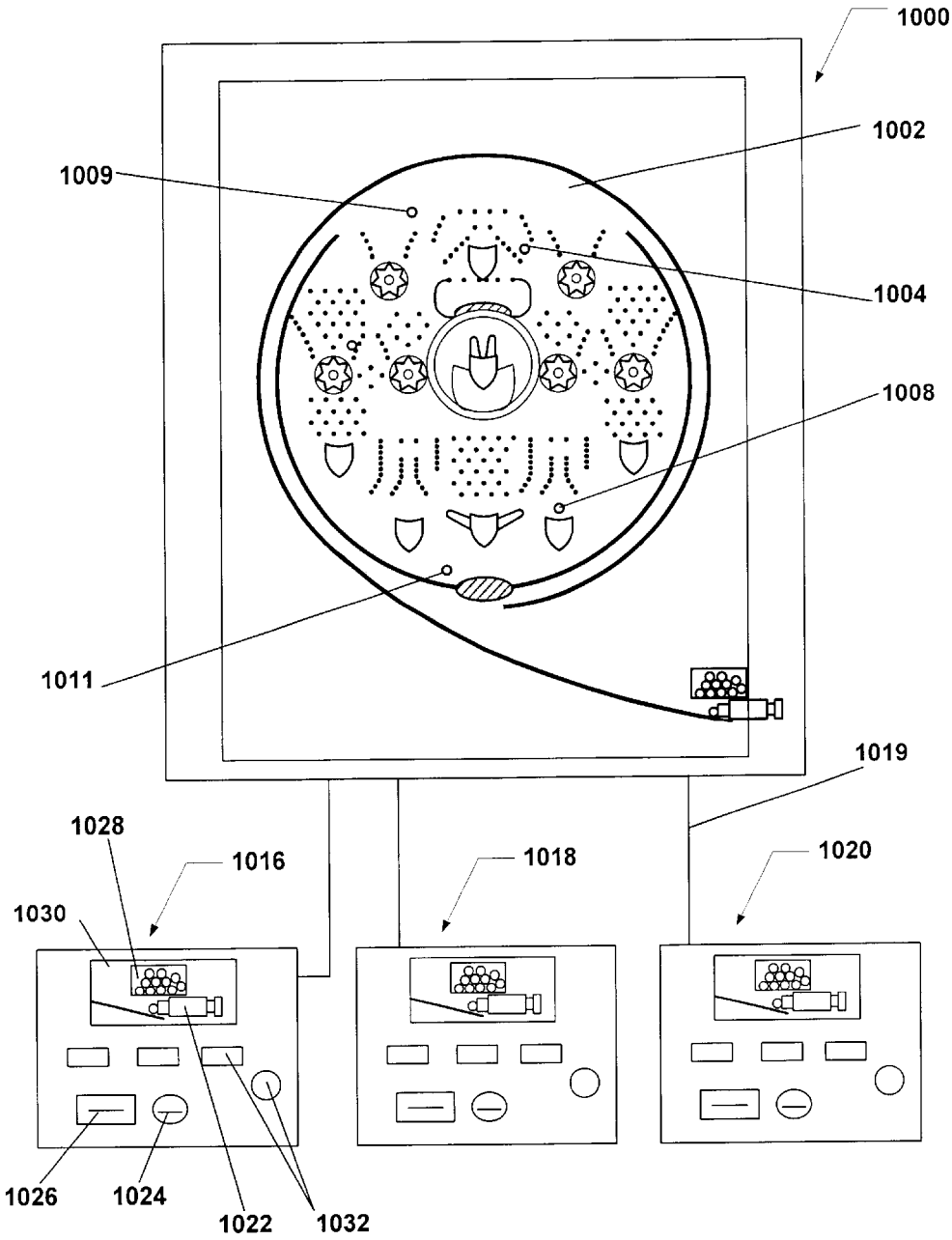
FIG. 10 is a block diagram depicting parallel game play by multiple players on a shared display screen.

FIG. 10 is a block diagram depicting parallel game play by multiple players on a shared display screen. Three player input panels 1016, 1018, 1020 are shown which may allow up to 3 players to play a video pachinko game simultaneously on a shared display screen 1000. However, the number of players, which may share game play, is not limited to 3 players. Each player input panel is connected to the shared display screen 1000 through a connection system 1019 of some type. For example, the connection system may be a fiber optic connection system or a wireless connection system. Using the input panel 1016, a player may insert money or credit of indicia using the bill validator 1026 and coin acceptor 1024. As described with reference to FIGS. 2–4, a player may make a wager and initiate a game using the ball reservoir 1028 and plunger 1022 on display screen 1030. The input panel may be mounted to a gaming machine or a separate device.

Using the input panels 1016, 1018 and 1020, 3 players may make wagers and initiate pachinko game play. The game outcome presentations for each player are displayed on the shared game display 1000 in the pachinko game playing area 1002. For example, player 1 may initiate game A 1004 and then game D 1011 from input panel 1016, player 2 may initiate game B 1008 from input panel 1018 and player 3 may initiate game C 1009 from input panel 1020. Each player may initiate another game before the game outcome presentations of the game or games that they have initiated by other players have are complete. Games 1004, 1008, 1009 and 1011 are simultaneously displayed on the shared display screen 1000. The wagers for games 1004, 1008, 1009 and 1011 may be the same or different. Although the game outcome presentations for each game may appear to interact, the game outcomes for each game are calculated independently as previously described.

The shared display 1000 may be located in a manner that allows each player to view the game outcome presentation for their games. Additionally, the games initiated by each player may be represented in a manner that allows each player to distinguish their games from another player's games. For example, on the display 1000, games 1002 and 1011 initiated by player 1 may be red, game 1004 initiated by player 2 may be green and game 1009 initiated by player 3 may be purple.

In another the embodiment, game outcome presentations initiated by one player may be simultaneously displayed on another gaming machine. For example, when a player initiates a first game on a first gaming machine, the game outcome presentation is simultaneously displayed on one or more gaming machines different from the gaming machine on which the first game was initiated. Thus, for groups of gaming machines connected in this manner, all the game outcome presentations initiated by multiple players, playing games on different gaming machines, may be viewed by each player on their gaming machine. For example, when the player input panel 1016 is on a first gaming machine, the player input panel 1018 is on a second gaming machine, and the player input panel 1020 is on a third game machine, the game outcome presentations initiated from each input panel may, be combined. The combined display of all the game outcome game presentations may be duplicated and displayed on a display device on each gaming machine. For example, each of the three gaming machines might display the combined game outcome presentation shown on the shared game display 1000.

In another embodiment, a game outcome presentation on a display screen on one gaming machine may be simultaneously displayed on a second display screen during particular game events. For example, when a game is being played on a gaming machine including player input panel 1016 and a bonus game is triggered, the game outcome presentation for the bonus game may be simultaneously displayed on the display screen 1030 and the shared display 1000. The display of bonus game events on a shared display such as 1000 may add to the excitement of game play for players on other gaming machines viewing the shared display.

The simultaneous game play by multiple players on one or more gaming machines may be included as part of group bonus game play. For example, when the sum of the wagers from 3 players initiating games from the player input panels 1016, 1018 and 1020 is above a certain amount, a bonus game shared by each player may be triggered. As another example, when the total number of balls on, the shared display screen 1000 is above a certain amount, a bonus game shared by each player may be triggered.

Although the foregoing invention has been described in some detail for purposes of clarity of understanding, it will be apparent that certain changes and modifications may be practiced within the scope of the appended claims. For instance, while the gaming machines of this invention have been depicted as having a display screen physically viewed through a vertical glass panel attached to a main gaming machine cabinet, the use of gaming devices in accordance with this invention is not so limited. For example, the display screen features may be provided on a table top gaming machine where the display screen is viewed through a horizontal glass panel.

What is claimed is:

1. A gaming machine comprising:

a master gaming controller designed or configured to determine an outcome of at least a first and a second pachinko game of chance and to control game outcome presentations for at least first and second corresponding pachinko games of chance in a manner allowing parallel game play of two or more separate pachinko game sequences each patio game sequence comprising:

1) receiving a wager for the pachinko game of chance wherein for each wager an input signal indicating that the wager has been made and indicating an amount of the wager is generated, 2) determining the game outcome for the pachinko game of chance and 3) presenting the game outcome for the pachinko game of chance on a video display the video display that is operable to simultaneously display the game outcome presentations generated for the two or more separate game sequences;

at least one input mechanism for receiving an input used by a player to make the wager and for each wager generating the input signal indicating that the wager has been made and indicating the amount of the wager;

wherein after a first input of a first wager has been received by the input mechanism for a first video pachinko game of chance in a first pachinko game sequence and prior to the completion of presenting the game outcome for the first pachinko game of chance the gaming machine is operable:

i) to receive a second input of a second wager for a second video pachinko game of chance in a second game pachinko game sequence and ii) to begin generating the second pachinko game sequence.

2. The gaming machine of claim 1, wherein said first pachinko game sequence is initiated on the gaming machine and a third pachinko game sequence is initiated on a second gaming machine wherein the second gaming machine and the gaming machine are operable to share trajectory information allowing a combined pachinko game outcome presentation to be generated including an object trajectory from said first pachinko game sequence and an object trajectory from said third pachinko game sequence on at least the video display.

3. The gaming machine of claim 2, wherein a game event in said first pachinko game sequence, a game event in said second pachinko game sequence, and combinations thereof trigger a bonus game.

4. The gaming machine of claim 1, wherein the game outcome presentations from the first pachinko game sequence initiated on the gaming machine and a third pachinko game sequence initiated on a second gaming machine are combined into a single pachinko game outcome presentation including an object trajectory from said first pachinko game sequence and an object trajectory from said third pachinko game sequence and are presented on a shared display screen viewable from the gaming machine and the second gaming machine.

5. The gaming machine of claim 1, wherein said game outcome presentations, each game outcome presentation including an object trajectory, in said pachinko game sequences generated on the gaming machine are displayed on a display screen of a second gaming machine.

6. The gaming machine of claim 1, wherein a third pachinko game outcome presentation from a third pachinko game sequence generated on a second gaming machine and the pachinko game outcome presentation from the first pachinko game sequence generated on the gaming machine are combined into a combined game outcome presentation to show an object trajectory from the third pachinko game sequence and an object trajectory from the first pachinko game sequence and the combined game outcome presentation is simultaneously displayed on the display screen of the first gaming machine and the display screen of the second gaming machine.

7. The gaming machine of claim 1, wherein the master gaming controller provides instructions for simultaneously displaying two or more previous pachinko game sequences for which the outcomes were previously determined.

8. The gaming machine of claim 1, further comprising a pay table stored on a memory device, wherein the master gaming controller uses the pay table to determine the outcome of the pachinko games of chance.

9. The gaming machine of claim 1, wherein the game outcome of each pachinko game of chance is not related to the pachinko game outcome of any other pachinko game of chance.

10. The gaming machine of claim 1, wherein the game outcome of the pachinko game of chance is related to a wager amount made on the pachinko game of chance.

11. The gaming machine of claim 1, wherein the game outcome of said second pachinko game of chance in said second pachinko game sequence is generated using a first wager amount on said first pachinko game of chance in said first pachinko game sequence and a second wager amount on the second pachinko game of chance in the second pachinko game sequence.

12. The gaming machine of claim 1, wherein the game outcome of said first pachinko game of chance is affected by how many pachinko game sequences are played in parallel.

13. The gaming machine of claim 1, wherein said first pachinko game outcome presentation is related to a number of pachinko game outcome presentations presented simultaneously with the first pachinko game outcome presentation.

14. The gaming machine of claim 1, wherein the master gaming controller provides instructions for displaying a bonus game and wherein a bonus game outcome presentation for the pachinko games of chance is related to a wager amount made on the pachinko games of chance.

15. The gaming machine of claim 1, wherein a bonus game outcome presentation for said first pachinko game of chance is related to how many pachinko game outcome presentations are presented simultaneously with the first pachinko game outcome presentation.

16. The gaming machine of claim 1, wherein the display screen is selected from the group consisting of a video display screen, a video touch screen and LCD screen.

17. The gaming machine of claim 1, further comprising one or more input mechanisms for initiating the pachinko games of chance, inputting a wager on the pachinko games of chance and combinations thereof.

18. The gaming machine of claim 17, wherein the one or more input mechanisms is for altering the pachinko games outcome presentation on the display screen.

19. The gaming machine of claim 17, wherein the one or more input mechanisms are selected from the group consisting of a video touch screen and input buttons.

20. The gaming machine of claim 17, wherein the one or more input mechanism is for selecting a game presentation mode.

21. The gaming machine of claim 20, wherein the game presentation mode is selected from the group consisting of a pachinko ball speed, a pachinko ball size, a pachinko ball elasticity, a pachinko game background pattern and a pachinko game layout.

22. The gaming machine of claim 20, wherein a first game presentation mode for said first pachinko game of chance is different from a second game presentation mode of said second pachinko game of chance.

23. The gaming machine of claim 1, wherein a first pachinko game outcome is determined by the master gaming controller from a first pay table and a second pachinko game outcome is determined by the master gaming controller from a second pay table.

24. The gaming machine of claim 1, wherein the game outcome presentations includes a presentation of a bonus game.

25. The gaming machine of claim 24, wherein the bonus game presentation is related to an award including a progressive award.

26. The gaming machine of claim 1, wherein a first pachinko game ball in said first pachinko game outcome presentation and a second pachinko game ball in said second pachinko game outcome presentation appear to interact on the display screen.

27. The gaming machine of claim 1, wherein a pachinko game ball is selected from a pachinko ball reservoir on the video display.

28. The gaming machine of claim 27, wherein the pachinko game balls are color coded to represent different wager amounts.

29. A method of generating video pachinko games of chance on a gaming machine, having a video display and an input mechanism the method comprising:

receiving on the input mechanism a first input specifying a first wager amount for a first pachinko game of chance played in a first pachinko game sequence;

generating a first input signal for indicating that the first wager has been made and indicating said first wager amount;

determining a game outcome for the first pachinko game of chance;

generating a game outcome presentation for the first pachinko game of chance;

displaying the game outcome presentation and the determined game outcome for the first pachinko game of chance on the video display;

after receiving the first input and prior to the completion of displaying the determined game outcome for the first pachinko game of chance, receiving on the input mechanism a second input specifying a second wager for a second pachinko game of chance played in a second pachinko game sequence;

generating a second input signal for indicating that the second wager has been made and for indicating a second wager amount;

determining a game outcome for the second pachinko game of chance;

generating a game outcome presentation for the second pachinko game of chance; and displaying the game outcome presentation and the determined game outcome for the second pachinko game of chance on the video display.

30. The gaming machine of claim 1, wherein the outcomes of the pachinko games of chance are determined using a random number generator.

31. The method of claim 29, wherein the first wager amount is different from the second wager amount.

32. The method of claim 29, wherein the game outcome of said first pachinko game of chance is determined from a first pay table and the game outcome of said second video pachinko game of chance is determined from a second pay table.

33. The method of claim 32, wherein the first pay table and the second pay table are the same.

34. The method of claim 29, further comprising presenting a bonus game in one of the video pachinko games of chance.

35. The method of claim 34, wherein the bonus game is selected from the group consisting of a pachinko game, a slot game, a keno game, and a poker game.

36. The method of claim 34, further comprising receiving an input signal to start the bonus game, determining a bonus game outcome and presenting the bonus game outcome.

37. The method of claim 29, further comprising after receiving the second input and prior to the completion of displaying the presentation of the pachinko game outcome in the first pachinko game of chance or prior to the completion of displaying the pachinko game outcome in the second pachinko game of chance, receiving on the input mechanism a third input specifying a third wager for a third pachinko game of chance played in a third pachinko game sequence;

generating a third input signal indicating that the third wager has been received and indicating the third wager amount;

determining a game outcome for the third pachinko game of chance; generating a game outcome presentation for the third pachinko game of chance; and displaying the game outcome presentation and the determined game outcome for the third pachinko game of chance on the video display.

38. The method of claim 29, wherein at least the first game outcome presentation and the second game outcome presentation are simultaneously displayed.

39. The method of claim 29, wherein the first game outcome presentation and the second game outcome presentation appear to interact.

40. The method of claim 29, further comprising receiving a presentation mode signal prior to presenting the game outcome for the pachinko game of chance.

41. The method of claim 40, wherein the presentation mode signal carries information about a pachinko ball speed, a pachinko ball size, a pachinko ball elasticity, a pachinko game background pattern and a pachinko game layout.

42. The method of claim 29, further comprising determining a game presentation mode for said first video pachinko game of chance prior to presenting the game outcome for said first video pachinko game of chance and determining a game presentation mode for said second video pachinko game of chance prior to presenting the game outcome for said second video pachinko game of chance.

43. The method of claim 42, wherein the game presentation mode is selected from the group consisting of a pachinko ball speed, a pachinko ball size, a pachinko ball elasticity.

44. The method of claim 42, wherein the game presentation mode for said first video pachinko game of chance is different from the game presentation mode for said second video pachinko game of chance.

45. The method of claim 29, further comprising summing the first wager amount made in said first video pachinko game of chance to the second wager amount made in said second video pachinko game of chance prior to determining the game outcome for said second video pachinko game of chance and determining the game outcome for said second video pachinko game of chance using the sum of said first wager amount and said second wager amount.

46. The method of claim 29, further comprising determining when to present a bonus game based on amount wagered on one of the video pachinko games of chance.

47. The method of claim 29, further comprising after a new wager is received for a new video pachinko game of chance and when the new video pachinko game of chance is initiated, determining a total number of video pachinko games of chance that are being concurrently generated with the new video pachinko game of chance and using the total number of video pachinko games of chances being concurrently generated in calculating the game outcome for the new pachinko game of chance.

48. The method of claim 47, further comprising determining when to present a bonus game using the total number of video pachinko games of chances being concurrently generated.

49. The method of claim 29, further comprising receiving an input signal from an input mechanism prior to presenting a game outcome for at least one of said video pachinko games of chance wherein the input signal includes information for specifying a parameter that affects the appearance of the game outcome presentation and generating the game outcome presentation for the one video pachinko game of chance using information from the input signal.

50. The method of claim 49, wherein the input mechanism is an input button or a touch screen.

51. The method of claim 29, further comprising selecting a particular pachinko ball from a ball reservoir displayed on the display screen prior to receiving an input signal to start at least one of the video pachinko games of chance wherein the selected pachinko ball is used in the pachinko game outcome presentation for the video pachinko game of chance.

52. The method of claim 29, further comprising selecting a trajectory from a trajectory database for generating a game outcome for the video pachinko games of chance.

53. The method of claim 29, further comprising:

receiving an input signal to initiate one of the pachinko games of chance.

54. The method of claim 29, further comprising:

calculating the game outcome for each the pachinko games of chance using a random number generator.

55. The method of claim 29, further comprising receiving an input signal to launch a pachinko ball in one of the pachinko games of chance.

56. A gaming machine comprising:

a video display for displaying a pachinko game of chance;

a master gaming controller designed or configured to determine an outcome of at least two pachinko games of chance and provide instructions for presenting the outcome on the video display; wherein the master gaming controller is operable to allow a plurality of corresponding pachinko game sequences to be generated in parallel, each pachinko game sequence comprising:

1) receiving a wager for the pachinko game of chance wherein for each wager an input signal indicating that the wager has been made and indicating an amount of the wager is generated, 2) determining the game outcome for the pachinko game of chance and 3) presenting the game outcome for the pachinko game of chance on the video display at least one input mechanism for receiving an input used by a player to make the wager and for each wager generating the input signal indicating that the wager has been made and indicating the amount of the wager;

wherein after a first input of a first wager has been received by the input mechanism for a first video pachinko game of chance in a first pachinko game sequence and prior to the completion of presenting the game outcome for the first pachinko game of chance the gaming machine is operable:

i) to receiver a second input of a second wager for a second video pachinko game of chance in a second game pachinko game sequence and ii) to begin generating the second pachinko game sequence wherein the first pachinko game sequence is initiated on the gaming machine and a third pachinko game sequence is initiated on a second gaming machine wherein the second gaming machine and the gaming machine are operable to share trajectory information allowing a combined pachinko game outcome presentation to be generated including an object trajectory from said first pachinko game sequence and an object trajectory from said third pachinko game sequence and the gaming machine is operable to display the combined pachinko game outcome presentation.

57. A gaming machine comprising:

a video display for displaying a pachinko game of chance;

a master gaming controller designed or configured to determine an outcome of at least two pachinko games of chance and provide instructions for presenting the outcome on the video display; wherein the master gaming controller is operable to allow a plurality of corresponding pachinko game sequences to be generated in parallel, each pachinko game sequence comprising:

1) receiving a wager for the pachinko game of chance wherein for each wager an input signal indicating that the wager has been made and indicating an amount of the wager is generated, 2) determining the game outcome for the pachinko game of chance and 3) presenting the game outcome for the pachinko game of chance on the video display at least one input mechanism for receiving an input used by a player to make the wager and for each wager generating the input signal indicating that the wager has been made and indicating the amount of the wager;

wherein after a first input of a first wager has been received by the input mechanism for a first video pachinko game of chance in a first pachinko game sequence and prior to the completion of presenting the game outcome for the first pachinko game of chance the gaming machine is operable:

i) to receive a second input of a second wager for a second video pachinko game of chance in a second game pachinko game sequence and ii) to begin generating the second pachinko game sequence wherein one or more game outcome presentations, each game outcome presentation including an object trajectory, in the plurality of pachinko game sequences generated on the gaming machine are displayed on a display screen of a second gaming machine.

* * * * *